US010641066B2

(12) United States Patent
Mericas et al.

(10) Patent No.: US 10,641,066 B2
(45) Date of Patent: May 5, 2020

(54) MODULAR DOWNHOLE DEBRIS SEPARATING ASSEMBLIES

(71) Applicant: Halliburton Energy Services, Inc., Houston, TX (US)

(72) Inventors: Chris J. Mericas, Houston, TX (US); Henry Eugene Rogers, Oklahoma, OK (US); Todd Anthony Stair, Spring, TX (US); Luke C. Downey, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 177 days.

(21) Appl. No.: 15/574,394

(22) PCT Filed: Jul. 6, 2015

(86) PCT No.: PCT/US2015/039208
§ 371 (c)(1),
(2) Date: Nov. 15, 2017

(87) PCT Pub. No.: WO2017/077447
PCT Pub. Date: Jan. 12, 2017

(65) Prior Publication Data

US 2018/0135388 A1 May 17, 2018

(51) Int. Cl.
*E21B 43/08* (2006.01)
*E21B 43/02* (2006.01)
*E21B 21/00* (2006.01)

(52) U.S. Cl.
CPC ..... *E21B 43/08* (2013.01); *E21B 21/002* (2013.01); *E21B 43/02* (2013.01)

(58) Field of Classification Search
CPC ..... E21B 43/08; E21B 21/002; E21B 43/02; E21B 27/00; E21B 27/005; E21B 27/04
(Continued)

(56) References Cited

U.S. PATENT DOCUMENTS 2,202,272 A * 5/1940 Smith ..... F01N 1/083 181/270
2,659,442 A 11/1953 Sutliff
(Continued)

FOREIGN PATENT DOCUMENTS

CA 2684547 10/2008
CA 2962196 5/2019
(Continued)

OTHER PUBLICATIONS

Canadian Patent Application No. 2,987,896, "Office Action", dated Oct. 2, 2018, 4 pages.
(Continued)

*Primary Examiner* — Michael R Wills, III
(74) *Attorney, Agent, or Firm* — Kilpatrick Townsend & Stockton LLP

(57) ABSTRACT

A downhole system can include multiple sub-components of a downhole debris separator assembly that is modular. The system can also include multiple couplers arranged on or among the sub-components of the multiple sub-components. Each of the couplers can connect with others of the couplers in different combinations to form respectively different configurations of the downhole debris separator assembly.

20 Claims, 11 Drawing Sheets

(58) Field of Classification Search
USPC ..... 166/311, 173
See application file for complete search history.

(56) References Cited

U.S. PATENT DOCUMENTS

| | | | | |
|---|---|---|---|---|
| 2,728,553 | A * | 12/1955 | Edwards | E21B 27/00 175/308 |
| 2,728,599 | A * | 12/1955 | Moore | E21B 27/00 294/86.11 |
| 2,874,781 | A * | 2/1959 | McGaffey | E21B 27/00 166/167 |
| 3,425,913 | A * | 2/1969 | Holden | B01D 17/0211 196/14.5 |
| 3,559,760 | A | 2/1971 | Ninomiya | |
| 3,747,347 | A * | 7/1973 | Ciraolo | F01N 1/083 60/309 |
| 3,831,753 | A | 8/1974 | Gaylord et al. | |
| 4,154,313 | A | 5/1979 | Dysart et al. | |
| 4,341,273 | A | 7/1982 | Walker et al. | |
| 4,515,212 | A | 5/1985 | Krugh | |
| 4,704,207 | A | 11/1987 | Chu | |
| 4,732,677 | A | 3/1988 | Thornton et al. | |
| 4,981,368 | A | 1/1991 | Smith | |
| 5,249,626 | A | 10/1993 | Gibbins | |
| 5,423,904 | A | 6/1995 | Dasgupta | |
| 6,143,254 | A * | 11/2000 | Erven | B01D 53/565 422/169 |
| 6,276,452 | B1 | 8/2001 | Davis et al. | |
| 6,352,111 | B1 | 3/2002 | Bode et al. | |
| 6,382,318 | B1 | 5/2002 | Whitlock et al. | |
| 6,574,869 | B1 | 6/2003 | McHenry et al. | |
| 6,824,749 | B2 * | 11/2004 | Leloup | B01J 10/007 422/211 |
| 7,093,653 | B2 | 8/2006 | Metcalfe et al. | |
| 7,174,957 | B1 | 2/2007 | Jokhio | |
| 7,188,687 | B2 | 3/2007 | Rudd et al. | |
| 7,188,688 | B1 | 3/2007 | LeJeune | |
| 7,472,745 | B2 | 1/2009 | Lynde et al. | |
| 8,360,153 | B2 * | 1/2013 | Ford | E21B 43/121 166/173 |
| 2004/0040703 | A1 | 3/2004 | Longmore et al. | |
| 2004/0244988 | A1 | 12/2004 | Preston et al. | |
| 2005/0039813 | A1 | 2/2005 | Dougherty et al. | |
| 2005/0200127 | A1 | 9/2005 | Johnson et al. | |
| 2008/0087419 | A1 | 4/2008 | Fair | |
| 2008/0209898 | A1 | 9/2008 | Succi et al. | |
| 2008/0308274 | A1 | 12/2008 | MacDougall et al. | |
| 2009/0226330 | A1 | 9/2009 | Denne et al. | |
| 2009/0238729 | A1 | 9/2009 | Glover et al. | |
| 2011/0024112 | A1 | 2/2011 | Ford | |
| 2011/0049025 | A1 | 3/2011 | Davis et al. | |
| 2011/0192602 | A1 | 8/2011 | Yeh et al. | |
| 2012/0292047 | A1 | 11/2012 | Knobloch, Jr. et al. | |
| 2013/0025865 | A1 | 1/2013 | Knobloch, Jr. et al. | |
| 2013/0341027 | A1 * | 12/2013 | Xu | E21B 27/005 166/301 |
| 2014/0251894 | A1 * | 9/2014 | Larson | B01D 33/0361 210/330 |
| 2015/0267511 | A1 | 9/2015 | Patterson | |
| 2017/0211362 | A1 * | 7/2017 | Rogers | E21B 43/08 |
| 2017/0355624 | A1 | 12/2017 | Baski | |
| 2018/0266231 | A1 | 9/2018 | Rogers et al. | |
| 2018/0363427 | A1 | 12/2018 | Gao et al. | |

FOREIGN PATENT DOCUMENTS

| | | |
|---|---|---|
| EP | 2245261 | 9/2013 |
| JP | 07025912 | 5/1995 |
| KR | 1020020092569 | 12/2002 |
| NL | 1021873 | 5/2004 |
| WO | 2014065962 | 5/2014 |
| WO | 2016060648 | 4/2016 |
| WO | 2016068885 | 5/2016 |
| WO | 2016068887 | 5/2016 |
| WO | 2016072982 | 5/2016 |

OTHER PUBLICATIONS

International Patent Application No. PCT/US2015/039208, International Search Report and Written Opinion dated Apr. 1, 2016, 13 pages.

Canadian Application No. 2,987,896, "Office Action", dated May 30, 2019, 4 pages.

* cited by examiner

MODULAR DOWNHOLE DEBRIS SEPARATING ASSEMBLIES

TECHNICAL FIELD

The present disclosure relates generally to devices for use in a wellbore in a subterranean formation and, more particularly (although not necessarily exclusively), to modular assemblies for separating debris in a downhole environment.

BACKGROUND

Preparing a well system traversing a hydrocarbon bearing subterranean formation often involves running a string of tubular members (often individually called "tubulars" or "joints") from surface into place in a wellbore. The string can be filled with fluid by permitting wellbore fluid to enter the string, e.g., via "auto-filling" equipment at a lower-most end of the string. The wellbore fluid can contain debris, such as from drilling or other operations. The debris can adversely affect the performance of the auto-fill equipment, which can necessitate filling from surface and the associated costs in time and resources. Additionally or alternatively, debris passing the auto-filling equipment can become trapped in the tubulars. The trapped debris can settle within the tubulars and form masses that can impede or hinder subsequent operations in the wellbore.

DETAILED DESCRIPTION

Figure 1:
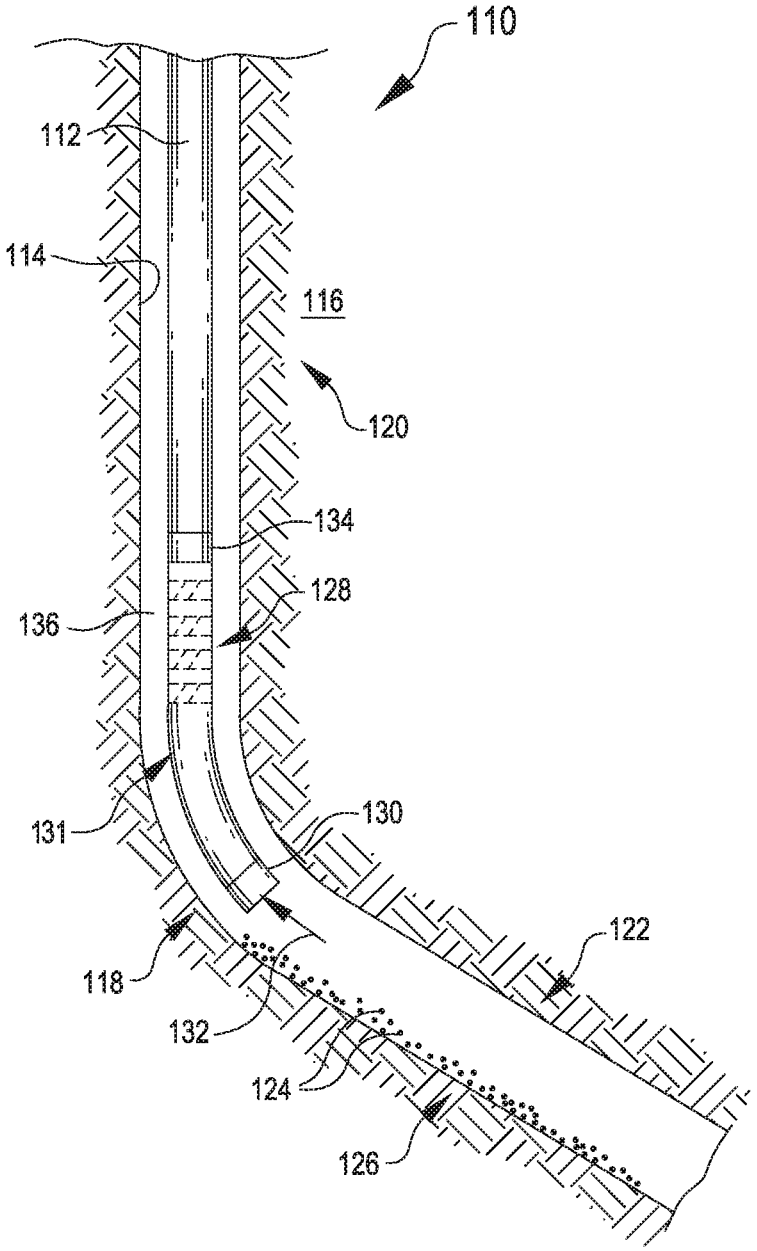
FIG. 1 is a schematic illustration of a well apparatus having a modular debris separator device according to certain aspects of the present disclosure.

Certain aspects and examples of the present disclosure are directed to modular assemblies for separating debris in a downhole environment. The assemblies can separate debris from wellbore fluid, e.g., to prevent debris from reaching or adversely affecting components receiving the wellbore fluid. For example, the assemblies may be arranged within a tubular to reduce or eliminate an amount of debris that is carried by wellbore fluid and that might otherwise contaminate auto-fill equipment. The assemblies can be modular, e.g., formed from a number of individual components that can be fit together in different combinations, orders, or arrangements.

In various aspects, the debris separator assemblies are customizable as a result of the modular construction. For example, the debris separator may be scalable. The modular construction may allow components of the debris separator to be added, removed, or substituted, such as to increase or decrease an amount of debris separation provided. In one example, extra components can be removed or added at the ends of an assembly or between components in an assembly of the debris separator. This may allow the debris separator to be readily changed in size, for example, to accommodate a shorter available section of a tubular or to increase an amount of debris separation in response to conditions present in a particular well operation.

In various aspects, the modular construction allows the debris separator to be customizable in other respects. The modular construction can allow different types of components to be interchanged with one another. In some aspects, this may facilitate modifications in relative orientation of features of components. In an illustrative example, a component with one angular orientation may be replaced by a component with a different angular orientation as a result of both components being compatible with a particular coupler. In another illustrative example, an amount of space between a pair of components may be changed by substituting one or more intervening components with one or more other components having a different total size.

The modular construction may reduce costs associated with the debris separator. For example, making the debris separator from a large number of repeated smaller modular components may reduce a size, number, or complexity of manufacturing infrastructure used for production. Additionally, smaller components may be shipped or stored in smaller, less expensive and more easily manageable packages than a package large enough to accommodate an entire assembly. Furthermore, installation may be simplified by installing a number of smaller sub-assemblies in stages in lieu of installing a complete assembly in a single large unwieldy unit.

These illustrative examples are given to introduce the reader to the general subject matter discussed here and are not intended to limit the scope of the disclosed concepts. The following describes various additional aspects and examples with reference to the drawings, in which like numerals indicate like elements, and directional descriptions (e.g., "left," "right") are used to describe the illustrative aspects as they are depicted in the drawings. Like the illustrative aspects, the numerals and directional descriptions included in the following should not be used to limit the present disclosure.

FIG. 1 illustrates an example of a well apparatus 110 having a debris separator device 128. The well apparatus 110 may include a casing string 112 that is being lowered into a wellbore 114 formed through a hydrocarbon-bearing subterranean formation 116. The debris separator device 128 may be positioned within a shoe track 131 of the casing string 112. The well apparatus 110 may be lowered into a heel portion 118 of the wellbore 114. The heel portion 118 may transition the wellbore 114 from a substantially vertically oriented section 120 of the wellbore 114 to a deviated (e.g., relatively horizontal or slanted) section 122 of the wellbore 114.

Prior to the well apparatus 110 being lowered into the wellbore 114, the wellbore 114 may have been drilled to a certain depth via a drill string that includes a drill bit. This previous drilling operation may have generated cuttings 124 or other debris from the drill bit cutting into the formation 116 to create the wellbore 114. These cuttings 124 may be distributed in a layer across a lower wall 126 of the deviated section 122 of the wellbore 114 as the casing string 112 is being run into the well. In some aspects, the cuttings 124 are additionally or alternatively suspended or otherwise carried by mud or other fluid within the wellbore 114.

The debris separator device 128 may separate cuttings 124 from mud flowing through the well apparatus 110 as the casing string 112 runs to depth. The debris separator device 128 may be run in with the casing string 112, e.g., at the bottom of the well apparatus 110. For example, the debris separator device 128 may form the bottom forty feet (or other amount) of the well apparatus 110 lowered into the wellbore 114.

In various aspects, the well apparatus 110 may facilitate auto-fill operations while the casing string 112 is being lowered. The auto-fill operations enable downhole fluid (e.g., mud) to flow up through the well apparatus 110 as the casing string 112 is being lowered. This may allow the casing string 112 to be run in to the wellbore 114 without a surface-mounted hydraulic pump being used to circulate fluid through the wellbore 114. Instead, as the casing string 112 is pushed downward through the wellbore 114, the mud may enter via a float shoe 130 of the well apparatus 110, as shown by arrow 132. This flow may be created as a result of running the well apparatus 110 into the wellbore 114 filled with mud and cuttings 124. The mud may continue to flow through the debris separator device 128, through a float collar 134, and into the casing string 112.

When performing a subsequent cementing operation, the well apparatus 110 may push cement downward through the casing string 112, float collar 134, debris separator device 128, and float shoe 130, and into an annulus 136 between the well apparatus 110 and the wellbore 114. The cement may push the mud back out of the casing string 112. The float collar 134 may include check valves that can facilitate a one-way flow of fluid and cement through the float collar 134 during the cementing operation. When operating as desired, the check valves close to prevent cement from creeping or flowing back up the casing string 112. This may allow the cement to set up in the annulus 136, thereby completing the cementing job. When the cementing job is completed, the debris separator device 128 and the float shoe 130 may also be filled with cement. From this point, the well may be completed or another drilling tool may be lowered to drill out the end of the well apparatus 110.

The debris separator device 128 may be used to capture and control the amount of cuttings 124 that flow into the well apparatus 110 with the mud as the well apparatus 110 is lowered. For example, the debris separator device 128 may keep the cuttings 124 from interfering with operation of the float collar 134. Specifically, if the cuttings 124 were to interfere with the check valve of the float collar 134, the check valve might fail to close after cement is run into the wellbore 114, thereby compromising the ability of the cement to flow into and properly set in the bottom of the well apparatus 110. To prevent this from happening, the debris separator device 128 in some aspects may be used to capture and periodically flush out cuttings 124 that enter the well apparatus 110 before the cuttings 124 reach the float collar 134.

In addition, the debris separator device 128 may capture and maintain the cuttings 124 in designated pockets of the debris separator device 128 while leaving a flow path open through designated conduits. This may prevent the cuttings 124 from bridging at the float collar 134. The term "bridging" refers to a large amount of cuttings 124 that might gather uphole of the check valve in the float collar 134 and act as a barrier that filters larger solids out of the cement mixture during the cementing process. In effect, this bridging may filter the cement so that a more watery cement substance than desired is output into the annulus 136 of the wellbore 114. As described in detail below, the debris separator device 128 may include various structures that capture and retain the cuttings 124, in order to prevent the occurrence of such bridging.

While FIG. 1 depicts the well apparatus 110 as being arranged in the heel portion 118 of a horizontally oriented wellbore 114, the well apparatus 110 may be equally arranged in a vertical or slanted portion of the wellbore 114, or any other angular configuration, without departing from the scope of the disclosure. Additionally, the well apparatus 110 may be arranged along other portions of the deviated section 122 of the wellbore 114 in order to secure the casing string 112 within a portion of the wellbore 114 without the interference of cuttings 124 and other particles entering the casing string 112. Furthermore, in some aspects, the debris separator device 128 may be used in other tubulars in addition to or as alternatives to the casing string 112.

In various aspects, the debris separator device 128 is modular in construction. This may allow the debris separator device 128 to be formed from a set of modules or sub-components (collectively termed "components" herein for ease of reference) that can be arranged together in different combinations, such as in different quantities, orders, orientations, or arrangements. The components can be arranged or coupled together so as to interact with one another and cause separation of debris from fluid flowing through the debris separator device 128. Such modular construction can allow greater flexibility for operations involving the debris separator device 128 and can reduce complexity or costs of manufacture, shipping, or installation of the debris separator device 128.

Components of the set may couple with one another to form sub-assemblies. In some aspects, the components may couple by directly connecting to one another. Additionally or alternatively, the components may couple indirectly, such as by two components each being coupled with a common object or through intervening structure. In one example, two components are arranged in series in a tubular to provide the function of the debris separator device 128 and are each coupled with the tubular, yet spaced apart therein so as to not be directly connected to one another.

The components of the debris separator device 128 can be coupled together by any suitable coupler or method of coupling. In some aspects, the debris separator device 128 may be modular as a result of couplers being compatible with multiple components or types of components. This may allow components of the debris separator device 128 to be interchangeable with respect to an individual coupler. In some aspects, modularity may be a result of each coupler being alternatively connectable with couplers of other components of the set of modular components. Non-limiting examples of suitable couplers include snap-together pieces, threaded components, pieces that are pinned in place; pieces that are glued or otherwise bonded together, and slip fitting one piece over another.

The debris separator device 128 may separate debris from flowing fluid in a variety of ways. The particular components combined to form the debris separator device 128 can determine how debris is separated. In some aspects, components (e.g., screens) obstruct particles and allow passage of fluid flow. In some aspects, components (e.g., impellers) affect fluid flow characteristics and cause particles to move out of the flow, e.g., away from designated conduits or into designated pockets. Components may include any combination of structure that facilitates component coupling, structure that defines a fluid path, and structure that removes particles out of a defined fluid path (e.g., directs particles away from the path or blocks particles from traveling along the path).

Different types of debris separator devices 128 can be used in the well apparatus 110 depicted in FIG. 1. The debris separator device 128 may include, but is not limited to, components that utilize any of the debris separating techniques or coupling techniques described in the following examples.

Example #1: Separating by Angularly Offset Pass-Through Areas

FIGS. 2-5 illustrate one example of a debris separator device 200. The debris separator device 200 can include plates 202 with pass-through areas 208. The pass-through areas 208 of the plates 202 can be angularly offset from one another or otherwise arranged to separate debris from fluid passing through the debris separator device 200. The debris separator device 200 can be modular by including snap-fitting sections of a mandrel 206 or other features that allow the plates 202 to be readily added, subtracted, or substituted to change the operation of the debris separator device 200.

Figure 2:
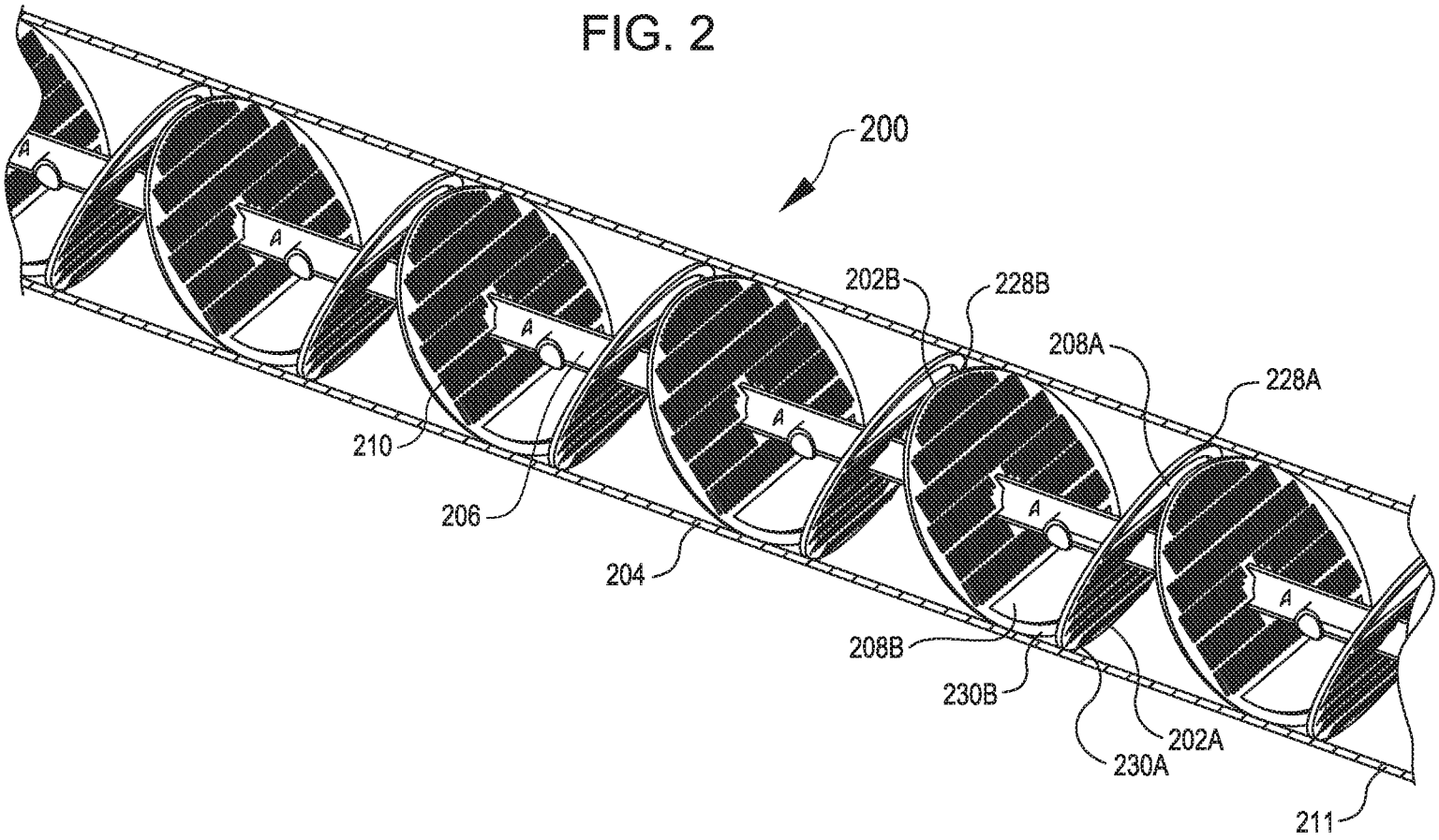
FIG. 2 is a perspective cutaway view of one example of a debris separator device according to certain aspects.

FIG. 2 is a perspective cutaway view of the debris separator device 200 according to some aspects. The plates 202 (e.g., 202A, 202B, etc.) of the debris separator device 200 can be positioned within a tubular member 204. In some aspects, the tubular member 204 can form part of a casing string, such as the casing string 112 in FIG. 1. In other aspects, the tubular member 204 may be inserted in to a casing string 112 having an internal diameter that is larger than an external diameter of the tubular member 204.

A plate 202 can include a corresponding pass-through area 208 (e.g., 208A, 208B, etc.). The pass-through area 208 can be an opening of sufficient size to allow fluid carrying particulate or debris to flow from a one side of the plate 202 to another, opposite side of the plate. In some aspects, the pass-through area 208 is positioned near an end or edge of a plate 202. As examples, the pass-through area 208 can be formed as a passage through the plate 202 (such as shown in FIG. 2) or as a gap between an edge of the plate 202 and an interior surface of the tubular member 204.

The pass-through area 208 can be positioned radially from a central axis of the tubular member 204. The plates 202 can be arranged such that pass-through areas 208 of adjacent plates 202 are positioned at different angular positions within the tubular member 204. The pass-through areas 208 can be angularly offset from one another. For example, the plates 202 can be arranged so that proximate pass-through areas 208 alternate between bordering a top of the tubular member and bordering a bottom of the tubular member (e.g., offset from one another by 180 degrees), as shown in FIG. 2.

Pass-through areas 208 additionally or alternatively can be offset from one another by any other suitable amount or angular increment, and are not limited to an offset of 180 degrees. In some aspects, offsets of less than 180 degrees (e.g., 120 degrees) can reduce a sensitivity of the debris separator device 200 to the direction of gravity. For example, the arrangement of the debris separator device 200 can improve the likelihood that at least one pass-through area 208 may be oriented toward the direction of gravity. This can facilitate a greater degree of settling of particles due to gravity in between the plates 202. Additionally, although a uniform offset between each pass-through area 208 is shown in FIG. 2, the offset between one pass-through area 208 and an immediately succeeding pass-through area 208 may differ from the offset between the pass-through area 208 and an immediately preceding pass-through area 208. Furthermore, although plates 202 and pass-through areas 208 are depicted in FIG. 2 as uniform features, these features may also vary from one another in size, shape, thickness, and orientation.

The plates 202 can be supported by a support structure, such as a mandrel 206. The manner or orientation in which the plates 202 are coupled with the mandrel 206 can determine a relative orientation of the plates 202 to one another. The relative arrangement of the plates 202 can align features of the plates 202 to reduce an amount of fluid-borne particulate that can pass through the debris separator device 200.

The plates 202 can be angled relative to a length of the tubular member 204. For example, the plates 202 can be tilted from a position perpendicular to a length of the tubular member 204. Any plate 202 can span an elongate or longitudinal section of the bore of the tubular member 204. One or more of the plates 202 can be elliptically shaped, which can facilitate the plate 202 spanning an elongate or longitudinal section of the bore of the tubular member 204. Although the plates 202 shown in FIG. 2 are elliptically shaped, in other embodiments, the plates 202 are circularly shaped to match a circular bore shape of the tubular member 204.

In some aspects, the plates 202 can be angled in an alternating manner along a length of the tubular member 204. For example, the plates 202 may alternate an angle of tilt so that adjacent plates 202 form a V-shape. In one illustrative example, a first plate 202A can have a top side 228A tilted forward from a perpendicular position and toward a first end 211 of the tubular member 204, while a second adjacent plate can have a top side 228B tilted backward from a perpendicular position and away from the first end 211 of the tubular member 204. The bottom sides 230A, 230B of the plates 202A, 202B can be adjacent to one another to form a point of the V-shape. In some aspects, the bottom sides 230A, 230B are spaced apart and not immediately adjacent one another. Although the plates 202 shown in FIG. 2 are angled relative to one another, in some aspects, the plates 202 may be parallel to one another.

In some aspects, at least some of the plates 202 include a screened section having perforations 210 through the plates 202. The perforations 210 can be sized to permit the passage of fluid through the plates 202, yet block passage of particulate carried by the fluid. A screened section can be formed in a plate 202 in any suitable manner, including, but not limited to, making perforations 210 directly in the plate 202 or stretching a mesh defining the perforations 210 across an open portion of the plate 202. A screened section can include any suitable number of perforations 210. In some aspects, perforations 210 substantially cover an entire area of the plate 202 not occupied by the pass-through area 208. In some aspects, smaller portions of the plate 202 include one or more screened sections with perforations 210.

Figure 3:
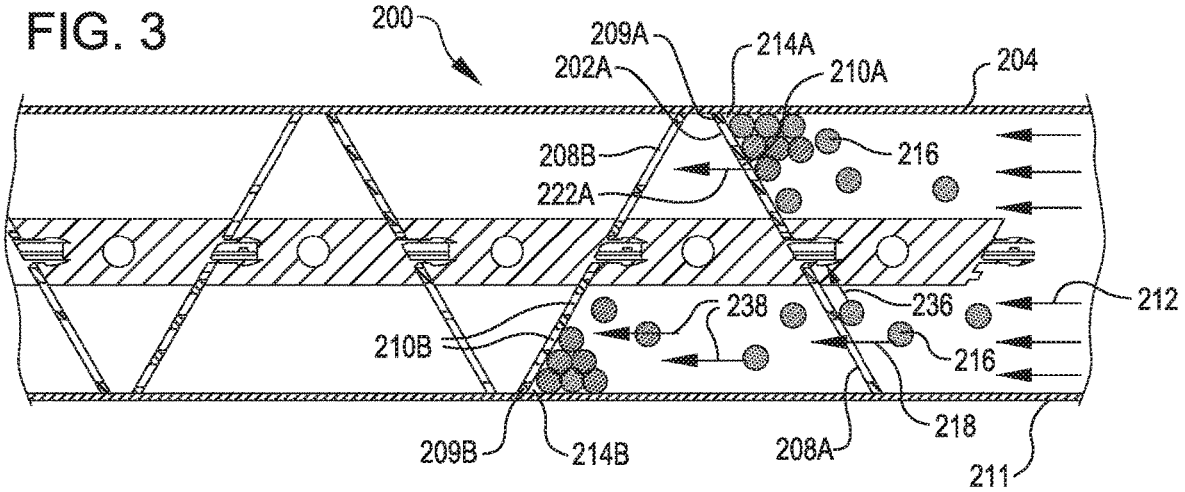
FIG. 3 is a side cutaway view of the debris separator device of FIG. 2, showing an example of flow in a first direction according to certain aspects.

FIG. 3 is a side cutaway view of the debris separator device 200, showing an example of fluid and particulate flow in a first direction according to certain aspects. Fluid can enter a first side 211 of the tubular member 204 (e.g., the right end in FIG. 3), as depicted by arrows 212 in FIG. 3. For example, the tubular member 204 can be moved within a wellbore 114 in a direction depicted to the right in FIG. 3, causing a flow in the leftward direction of FIG. 3. The fluid alternatively or additionally can be directed into the first end 211 of the tubular member 204 by auto-fill equipment or the like. The fluid entering the first end 211 of the tubular member 204 can convey particulate, including individual particles 216 (depicted in an enlarged manner for ease of visibility). The mandrel 206 can have closed ends, preventing passage of fluid through the mandrel 206.

A first plate 202A in the debris separator device 200 can be tilted. The tilt may angle the pass-through area 208A of the first plate 202A toward the first end 211 of the tubular member 204. The tilt may also angle an opposite closed end 209A of the first plate 202A away from the first end 211. Angling the first plate 202A in this manner can form a ramp along the first plate 202A toward a corner 214A formed between an edge of the first plate 202A and an interior surface of the tubular member 204.

In some aspects, particles 216 encountering a plate 202 can be moved along an angle of the plate 202 by fluid flow. For example, the fluid entering the tubular member 204 from the first end 211 can push particles 216 along the ramp formed by the angled first plate 202A, such as illustrated by arrow 236. The particles 216 can be moved along the angled first plate 202A toward the corner 214A (or pocket) formed between an edge of the first plate 202A and an interior surface of the tubular member 204. Moving particles 216 toward the corner 214A can clear particles 216 from perforations 210A, if present. Clearing the perforations 210 can allow additional fluid to travel through perforations 210A in the first plate 202A (as depicted by arrow 222A) and increase an amount of particles 216 that are screened out of the fluid.

A next plate 202B in the series in the debris separator device 200 can be tilted at a different angle relative to the bore of the tubular member 204. The second plate 202B can be tilted so that the second pass-through area 208B is tilted toward the source of fluid flow (e.g., toward the first end of the tubular member 204) and so that the closed end 209B forming a corner 214B is tilted away from the source of fluid flow. This may longitudinally align corner 214B or the closed end 209B (or both) with the pass-through area 208A. Altering the tilt of plates 202 along with the angular position of the pass-through areas 208 can allow particles 216 to be consistently pushed toward corners 214 and away from pass-through areas 208. For example, some particles 216 may pass through the pass-through area 208A instead of being directed along the angled first plate 202A toward the corner 214A. These particles passing through the pass-through area 208A can be directed by a longitudinal flow of fluid toward the corner 214B that is longitudinally aligned with the pass-through area 208A, such as illustrated by arrows 238.

If perforations 210 of a plate 202 are omitted or become blocked by accumulated particles 216, fluid laden with particles 216 can still pass through the pass-through area 208 of the plate 202. For example, fluid coming from the first end of the tubular member 204 as depicted by arrows 212 can pass through the pass-through area 208A (as depicted by arrow 218) even if perforations 210A are blocked or omitted. If perforations 210B are also blocked or omitted, the fluid may travel along a fluid path between the pass-through area 208A and pass-through area 208B.

The offset between the pass-through area 208A and pass-through area 208B can provide a tortuous path for the fluid flow. Direction changes from the tortuous path can remove particles 216 from the fluid passing through the debris separator device 200. For example, the particles 216 can be carried by momentum against a first plate 202A and dropped while the fluid changes direction between adjacent pass-through areas 208A, 208B that are offset from one another. In another example, the changes of direction from the tortuous path can reduce a speed of the fluid flow, thereby increasing a number of particles 216 that can drop or settle out of the fluid under the effects of gravity.

In some aspects, the tortuous path additionally or alternatively can yield other benefits. For example, routing cement through the tortuous path of the debris separator device 200 during a cementing operation may provide additional mixing for the cement and improve the quality of the cementing operation or the overall displacement efficiency of a section of a casing string 112 having the debris separator device 200.

Figure 4:
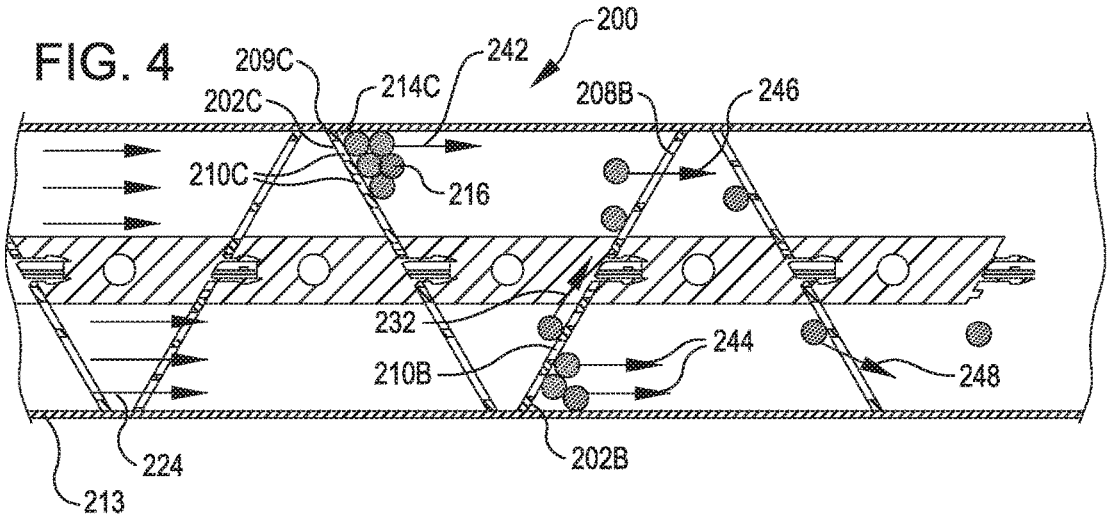
FIG. 4 is a side cutaway view of the debris separator device of FIGS. 2-3, showing an example of flow in a second direction according to certain aspects.

FIG. 4 is a side cutaway view of the debris separator device 200, showing an example of flow in a second direction according to some aspects. Fluid can enter from a second end 213, such as shown by arrow 224. The fluid entering from the second end 213 can include fewer particles 216 than fluid entering the debris separator device 200 from the first end 211 (such as the fluid discussed above with respect to the arrow 212 of FIG. 2). As examples, the fluid entering from the second end 213 may include fewer particles 216 as a result of having passed through debris separator device 200, as a result of being introduced from a surface of the wellbore 114, or both. The fluid entering from the second end 213 can flush particles 216 out of the debris separator device 200 and prepare the debris separator device 200 for additional operations.

Fluid flow through perforations 210C can dislodge particles 216 accumulated in the corner 214 between the plate 202C and the tubular member 204. Fluid flow from the second end 213 of the debris separator device 200 can direct the particles 216 towards a next plate 202B along the length of the debris separator device 200, as shown by arrow 242. Particles reaching the next plate 202B can be directed along the angle of the plate 202B toward the pass-through area 208B (as shown by arrow 232) and pass through the pass-through area 208B (as shown by arrow 246).

When fluid flows from the second end 213 of the debris separator device 200 along the plates 202, the pass-through areas 208 are angled away from the source of fluid, while the closed end 209 of the plate is oriented toward the source of fluid. This can provide a ramp for urging particles toward the pass-through area 208. The particles can thus be sequentially pushed through pass-through areas 208 and pushed out of the debris separator device 200, as shown by arrow 248. Additionally, the angle can direct the particles 216 away from perforations 210B, as shown by arrow 232. This can clear the perforations 210B and permit additional fluid to flow through and dislodge additional particles previously trapped by the perforations 210B, as illustrated by arrows 244.

Figure 5:
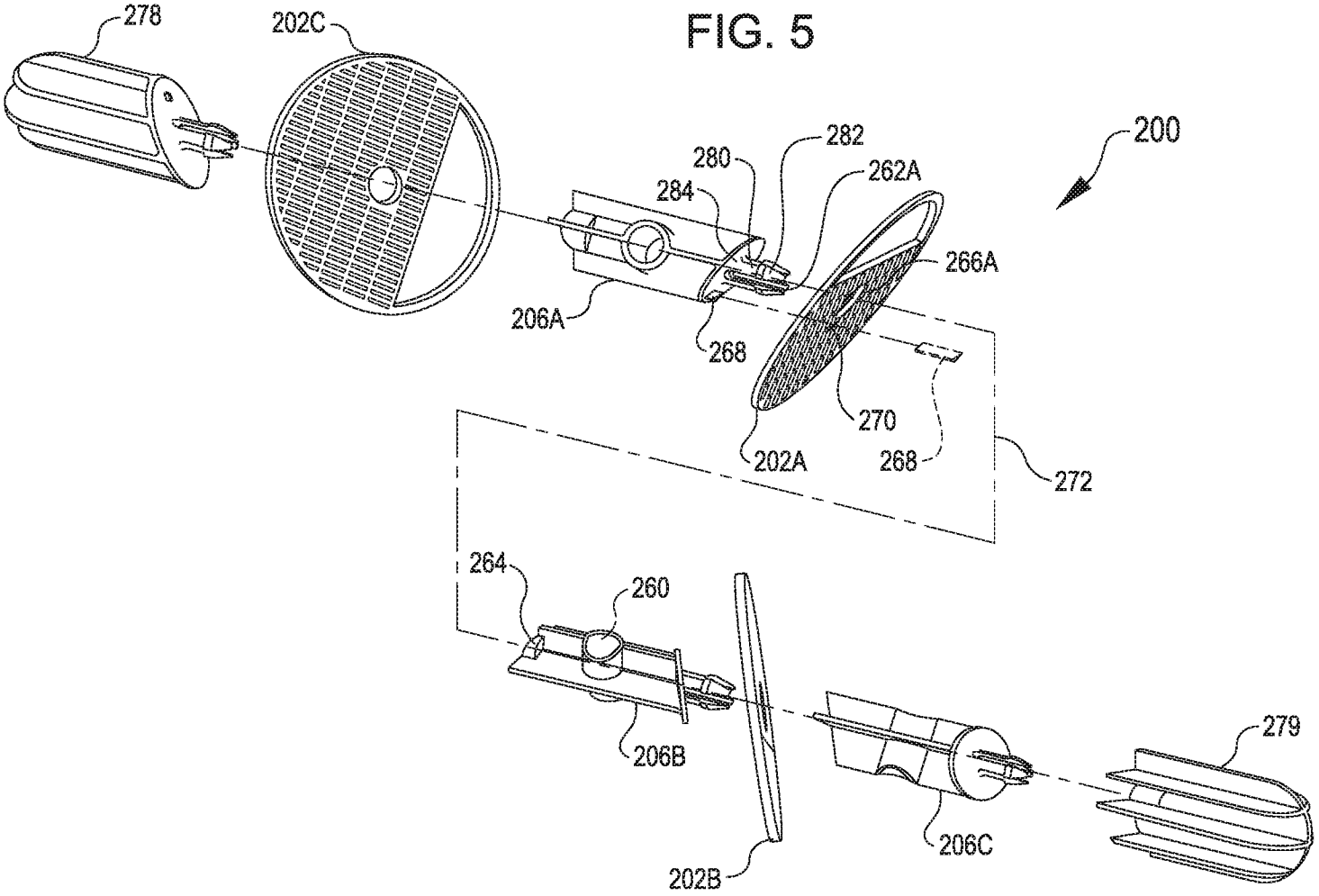
FIG. 5 is an exploded assembly view showing examples of components of the debris separator device of FIGS. 2-4 according to certain aspects.

FIG. 5 is an exploded view of examples of components of the debris separator device 200 according to some aspects. The debris separator device 200 shown in FIG. 5 includes mandrel sections 206 (e.g., 206A, 206B, etc.), plates 202 (e.g., 202A, 202B, etc.), and end caps 278, 279. The components are shown in FIG. 5 in a configuration to provide offsets of 120 degrees, in contrast to the offsets of 180 degrees shown in FIGS. 2-4.

The debris separator device 200 shown in FIG. 5 includes couplers (e.g., protrusions 262, openings 266, and collars 264) that facilitate a modular construction and connect components together. For example, a first mandrel section 206A can couple with a first plate 202A. The first mandrel section 206A can include a first protrusion 262A extending from one end. The first plate 202A can be translated onto the first protrusion 262A, such along line 272. The first protrusion 262A can extend through a central opening 266A (or opening 266A positioned other than centrally) of the first plate 202A for supporting the first plate 202A relative to the first mandrel section 206A. The first mandrel section 206A can also include an aligning feature so that the first plate 202A aligns in a particular orientation relative to the first mandrel section 206A. The aligning feature shown in FIG. 5 is a key 268 that can be inserted into a corresponding slot 270 in the first plate 202A; however other aligning features may be used. In some aspects, the key 268 may be an insertable pin (e.g., a bolt, screw, rivet, clip, hinge, or the like) that slides (e.g., from the position of the key 268 in phantom line in FIG. 5 to the position of the key 268 in solid line in FIG. 5) through the slot 270 and into engagement into the first protrusion 262A to secure the first plate 202A in place. The first protrusion 262A may include a first angled face 284, which may determine a tilt of the first plate 202A within the completed subassembly.

Other plates 202 may include similar features to the first plate 202A, which may allow any of the plates 202 of the debris separator device 200 to be coupled with the first mandrel section 206A, e.g., to change the order of plates 202, to change a type of plate 202 utilized, or to facilitate another modular change.

The first mandrel section 206A can also couple with a second mandrel section 206B. The first plate 202A may be secured in between the first mandrel section 206A and the second mandrel section 206B. The second mandrel section 206B may include a collar 264 that can be installed over the first protrusion 262A of the first mandrel section 206A. The collar 264 may fit over a portion of the first protrusion 262A extending through the first plate 202A (e.g., along line 272). The first protrusion 262A can include prongs 280 that extend through the collar 264. The prongs 280 can include barbs 282 that engage the collar 264. The barbs 282 may deflect and snap into place in response to the protrusion 262 being moved a sufficient distance through the collar 264. The second mandrel section 206B may include a second angled face 286 that matches the first angled face 284 of the first mandrel section 206A. This may limit a number of orientations at which the first mandrel section 206A can couple with the second mandrel section 206B, which may simplify installation by preventing coupling in a way other than intended. Alternatively or additionally, the prongs 280 may extend different lengths from the first angled face 284 so as to match different widths of the collar 264 along the second angled face 286.

Other mandrel sections 206 (including the first mandrel section 206A and the second mandrel section 206B) may include features similar to the features just described for the first mandrel section 206A and the second mandrel section 206B. This may allow any of the mandrel sections 206 to couple with any other of the mandrel sections 206 or with any of the plates 202 in the debris separator device 200, e.g., allowing additional modularity.

In some aspects, a mandrel section 206 can include a notch 260. The notch 260 can extend through the mandrel section 206 transverse to a length of the mandrel section 206. A bar or other leverage-providing component can be inserted into the notch 260 to provide a pushing surface by which a person can join the mandrel section 206 with another component of the debris separator device 200.

Any of the mandrel sections 206 may couple with an end cap 278, 279. A top or first end cap 278 may include a protrusion (similar to the protrusion 262) that can be received in a collar 264 of a mandrel section 206. A bottom or second end cap 279 may include a collar (similar to the collar 264) that can be received on a protrusion 262 of a mandrel section 206. Any of the end caps 278, 279 may include features (such as the key 268 or other aligning features) for coupling with plates 202. The end caps 278, 279 may be sized so as to be larger than openings through restrictions in a casing string 112, such as to prevent mandrel sections 206 or protrusions 262 from passing through such openings and reaching or damaging auto-fill or other equipment.

Example #2: Separating by Longitudinally Offset, Partial Screens

FIGS. 6-9 illustrate another example of a debris separator device 600. The debris separator device 600 can include screens 602. The screens 602 can cover different cross-sectional areas and be longitudinally offset from one another to separate debris from fluid passing through the debris separator device 600. The debris separator device 600 can be modular by including threaded surfaces 611, 613 (or other features) that allow sections with the screens 602 to be readily added, subtracted, or substituted to change the operation of the debris separator device 600.

Figure 6:
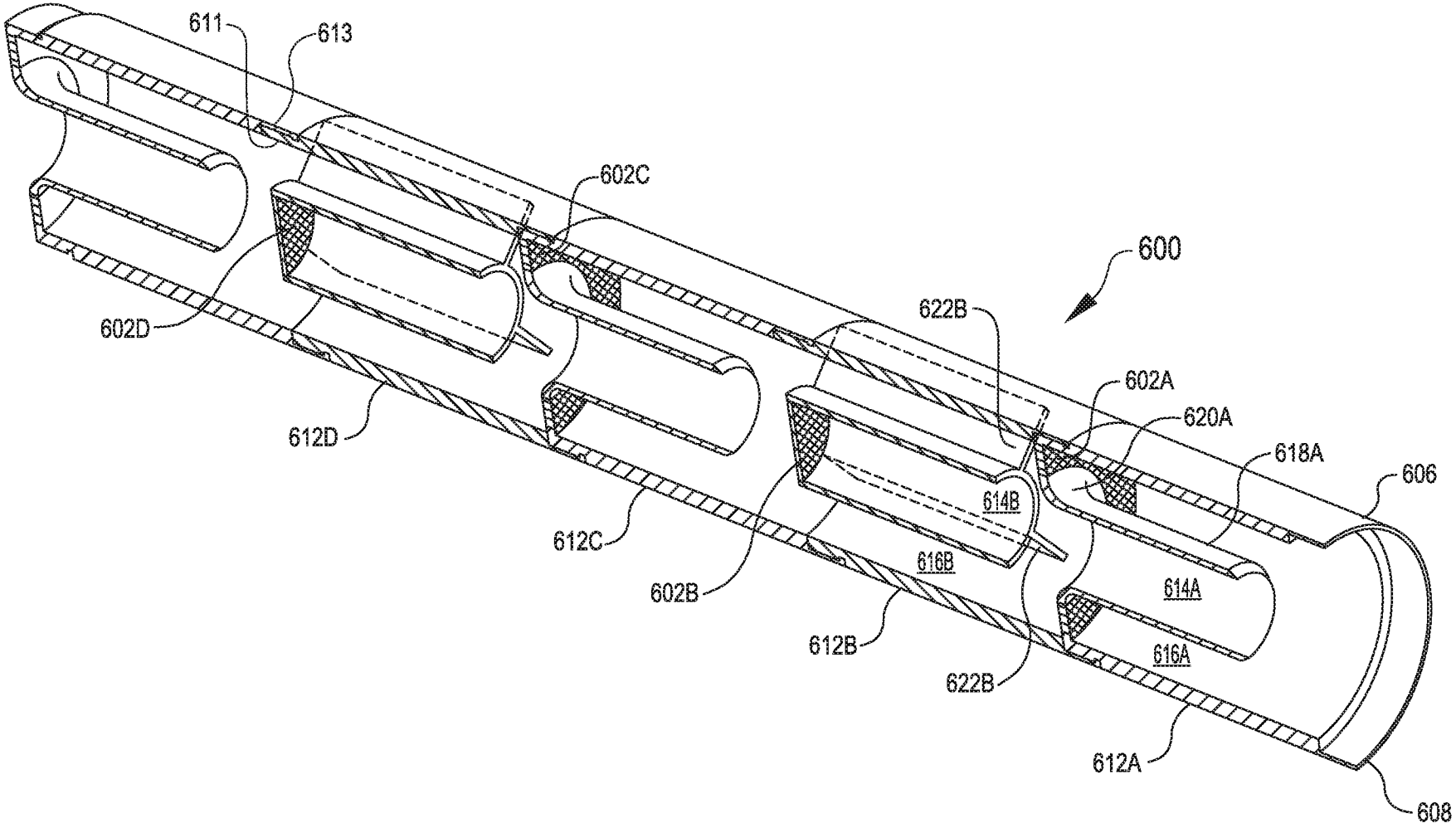
FIG. 6 is a perspective cutaway view of another example of a debris separator device according to certain aspects.

FIG. 6 is a perspective cutaway view of the debris separator device 600 according to some aspects. The debris separator device 600 can include screens 602 (e.g., a first screen 602A, a second screen 602B, a third screen 602C, and a fourth screen 602D). The screens 602 can be positioned within a tubular member 606. The screens 602 can include openings sized to permit the passage of fluid through the screens, yet block passage of particulate carried by fluid flowing through the debris separator device 600. The tubular member 606 can be divided into sections 612 (e.g., a first section 612A, a second section 612B, a third section 612C, and a fourth section 612D). The sections 612 shown in FIG. 6 are coupled by threaded surfaces 611, 613. Other couplers, however, can also be used. Each section 612 can correspond to a respective screen 602. Each respective screen 602 can be coupled with the respective section 612 by any suitable coupler. In some aspects, the tubular member 606 can form part of a tubing string, such as the casing string 112 in FIG. 1. In some aspects, the tubular member 606 may be inserted in to a casing string 112 having an internal diameter that is larger than an external diameter of tubular member 606.

The screens 602 can be longitudinally offset from one another in the tubular member 606. For example, a first screen 602A positioned in a first section 612A can be closer to a first end 608 of the tubular member 606 than a second screen 602B positioned in a second section 612B.

Figure 7:
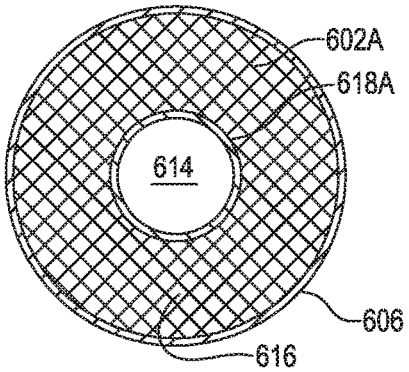
FIG. 7 is an end view of an example of a screen of the debris separator device of FIG. 6 according to certain aspects.
Figure 8:
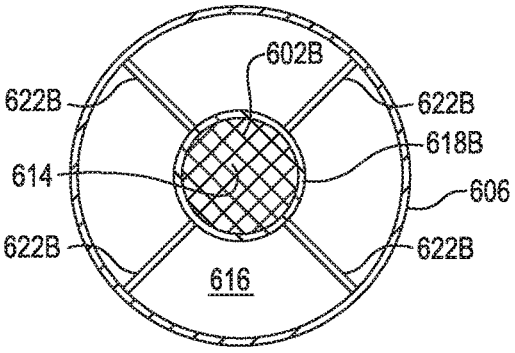
FIG. 8 is an end view of another example of a screen of the debris separator device of FIG. 6-7 according to certain aspects.

The screens 602 can cover different portions of a cross-sectional area of the tubular member 606. The different portions may collectively cover an entirety of the cross-sectional area. An example is provided with reference to FIGS. 7-8. FIG. 7 is an end view of the first screen 602A of the debris separator device 600 according to some aspects. FIG. 8 is an end view of the second screen 602B of the debris separator device 600 according to some aspects.

The first screen 602A (FIG. 7) can have an annular shape between an interior edge of the tubular member 606 and a central area 614 of the cross-sectional area of the tubular member 606. The annular shape of the first screen 602A can cover a peripheral area 616 of the cross-sectional area without covering the central area 614 of the cross-sectional area.

The second screen 602B (FIG. 8) can have a round shape covering the central area 614 without covering the peripheral area 616. The first screen 602A and the second screen 602B can thus collectively cover the entirety of the cross-sectional area of the tubular member 606. Collectively covering the entirety of the cross-sectional area of the tubular member 606 with screens 602 can reduce an amount of particles that may be carried through the debris separator device 600.

Although the entirety of the cross-sectional area of the tubular member 606 can be covered by a first screen 602A and a second screen 602B covering opposite portions of the cross-sectional area of the tubular member 606 as just described, other arrangements are possible. For example, the entirety of the cross-sectional area may be covered by a group of two, three, or more screens of complimentary shapes. A shape of one screen may be larger than an area not covered by another screen such that a portion of the cross-sectional area is covered multiple times where the shapes overlap.

The first screen 602A (FIG. 7) and the second screen 602B (FIG. 8) can each cover less than an entirety of the cross-sectional area of the tubular member 606. For example, the shape of the first screen 602A (FIG. 7) can leave the central area 614 uncovered, while the shape of the second screen 602B (FIG. 8) may leave the peripheral area 616 uncovered. Leaving at least a portion of the cross-sectional area of the tubular member 606 uncovered by a particular screen 602 can permit fluid to flow past the particular screen 602 when the particular screen 602 is blocked by particles.

Referring again to FIG. 6, the first screen 602A can include a first rim 618A. The first rim 618A can extend away from the first screen 602A and toward the first end 608 of the tubular member 606. In some aspects, the first rim 618A can be a tube. The first rim 618A can be positioned at a boundary of the portion of the cross-sectional area of the tubular member 606 covered by the first screen 602A. For example, the first rim 618A can be positioned at a boundary between the peripheral area 616 and the central area 614 (such as shown in both FIGS. 6 and 7). The first rim 618A can be sized to prevent particulate caught in the peripheral area 616 by the first screen 602A from crossing the boundary into the central area 614 and flowing past the first screen 602A. For example, the first rim 618A can extend toward the first end 608 of the tubular member 606 a sufficient amount to prevent particles from being swept from the first screen 602A and through the central area 614 by fluid flowing from the first end 608.

The second screen 602B can include a second rim 618B. The second rim 618B can extend away from the second screen 602B and toward the first end 608 of the tubular member 606. In some aspects, the second rim 618B can be a tube. The second rim 618B can be positioned at a boundary of the portion of the cross-sectional area of the tubular member 606 covered by the second screen 602B. For example, the second rim 618B can be positioned at a boundary between the central area 614 and the peripheral area 616 (such as shown in FIGS. 6 and 8). The second rim 618B can be sized to prevent particulate caught in the central area 614 by the second screen 602B from crossing the boundary into the peripheral area 616 and flowing past the second screen 602B. For example, the second rim 618B can extend toward the first end 608 of the tubular member 606 a sufficient amount to prevent particles from being swept from the second screen 602B and through the peripheral area 616 by fluid flowing from the first end 608.

In some aspects, the second rim 618B may be supported relative to the tubular member 606 by one or more flanges 622B (e.g., FIGS. 6 and 8). The second screen 602B may be supported relative to the tubular member 606 by the second rim 618B. In some aspects, the first screen 602A may be supported relative to the tubular member 606 by coupling with an interior edge of the tubular member 606 (e.g., FIG. 6-7). The first rim 618A may be supported relative to the tubular member 606 by the first screen 602A. In some aspects, the first rim 618A additionally or alternatively may be supported by flanges similar to the flanges 622B, although not shown in FIGS. 6-8. Flanges, screens, rims, and sections may be coupled with one another by any suitable coupler, including, but not limited to bonding or clipping.

Figure 9:
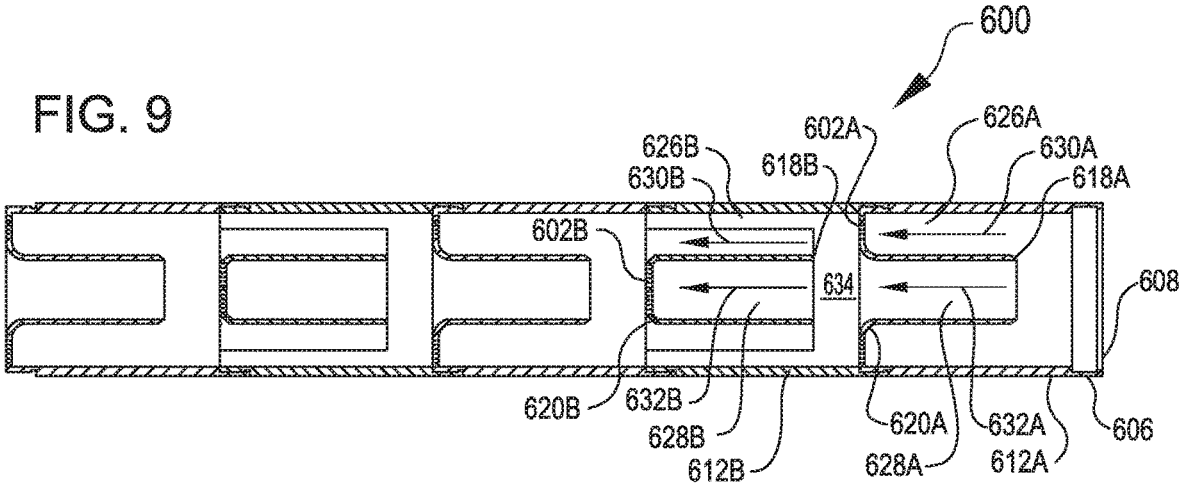
FIG. 9 is a side cutaway view of the debris separator device of FIG. 6 according to certain aspects.

FIG. 9 is a side cutaway view of the debris separator device 600 according to some aspects. In some aspects, the first rim 618A separates flow paths 626A, 628A through the first section 612A of the tubular member 606. For example, fluid flowing from the first end 608 of the tubular member 606 may encounter the first rim 618A and be directed through a first flow path 626A and a second flow path 628A. The first screen 602A can be positioned in the first flow path 626A. For example, the first screen 602A can cover an entirety of a cross-section of the first flow path 626A. The first screen 602A may prevent some particles carried by the fluid from passing the first section 612A or otherwise function as a pocket to capture particles.

The second flow path 628A of the first section 612A may be less screened than the first flow path 626A. For example, the first screen 602A may cover the second flow path 628A a negligible amount and permit particles to flow through the second flow path 628A without much, if any, screening. Fluid directed through the second flow path 628A of the first section 612A may carry at least some particles through the first section 612A and into the second section 612B.

The second rim 618B can separate the second section 612B into another first flow path 626B and another second flow path 628B. The second screen 602B can be positioned in the second flow path 628B of the second section 612B.

In some aspects, the first rim 618A and the second rim 618B are longitudinally aligned. Longitudinally aligning the first rim 618A and the second rim 618B may align flow paths of the first section 612A and the second section 612B for longitudinal fluid flow through at least one screen 602. For example, fluid can flow through the first flow paths 626A, 626B and the first screen 602A (such as depicted by the arrows 630A and 630B) or through the second flow paths 628A, 628B and the second screen 602B (such as depicted by the arrows 632A and 632B).

In some aspects, the first rim 618A and the second rim 618B are longitudinally offset. For example, a longitudinal gap 634 may be positioned between the first rim 618A and the second rim 618B. Longitudinally offsetting the first rim 618A and the second rim 618B can permit fluid to flow separately from aligned flow paths of the first section 612A and the second section 612B. For example, fluid can flow from the second flow path 628A of the first section 612A to the first flow path 626B of the second section 612B through a third flow path (such as the longitudinal gap 634) without passing through the first screen 602A or the second screen 602B (such as depicted by the arrows 632A and 630B). Such a flow may permit fluid to continue traveling through the tubular member 606 when the screens 602A, 602B are blocked with particles.

In some aspects, particles captured by the screens 602 can be flushed by directing fluid toward the first end 608 of the tubular member 606. For example, particles captured by the second screen 602B can be carried out through the second flow path 628B in the second section 612B and the aligned second flow path 628A of the first section 612A (such as opposite the arrows 632B, 632A). Particles carried through the first flow path 626B of the second section 612B can pass through the gap 634 and out through the second flow path 628A of the first section 612A (such as opposite the arrows 630B, 632A). The first rim 618A can include a tapered portion 620A tapering away from the first flow path 626B of the second section 612B and toward the second flow path 628A of the first section 612A. Such a tapered portion 620A can direct flushed particles toward the open, unscreened second flow path 628A of the first section 612A. Similarly, the second rim 618B can include a tapered portion 620B that directs particles away from the screened second flow path 628B (e.g., away from edges of the second screen 602B) and toward the open and unscreened first flow path 626B of the second section 612B.

Example #3 Debris Separator Device with Weirs

FIGS. 10-13 illustrate a further example of a debris separator device 1000 according to certain aspects. The debris separator device 1000 can include weirs 1014 (e.g., weirs 1014A, 1014B). The weirs 1014 can create a tortuous fluid flow to separate debris from fluid passing through the debris separator device 1000. The debris separator device 1000 can be modular by including slots 1110 in weir plates 1100, portions of inserts 1302 and 1304 that can be bonded together, coupling edges 1310 etc., or any other combination of features that allow assemblies with the weirs 1014 to be readily formed, added, subtracted, or substituted to change the operation debris separator device 1000.

Figure 10:
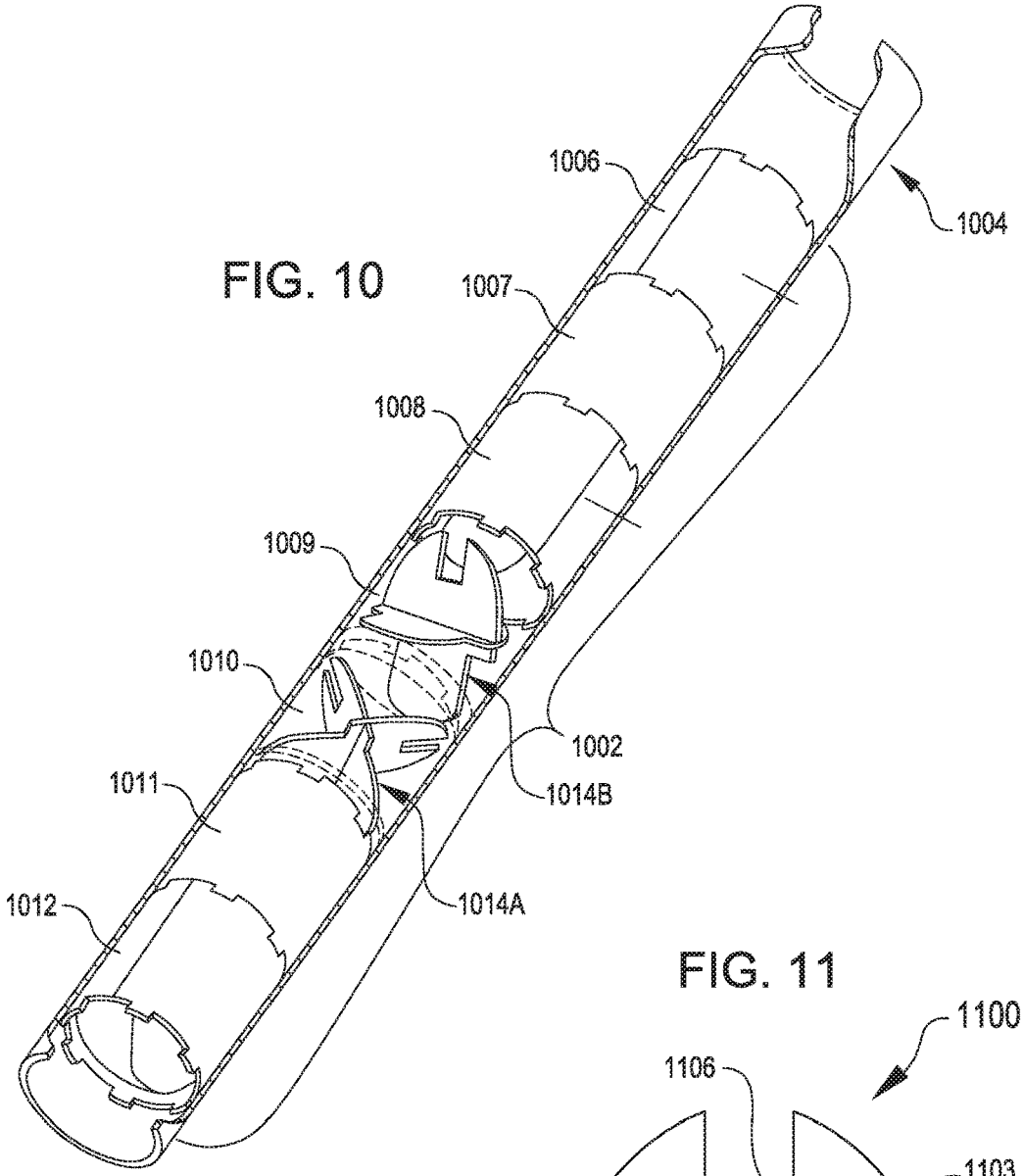
FIG. 10 is a perspective cutaway view of a further example of a debris separator device according to certain aspects.

FIG. 10 is a perspective cutaway view of the debris separator device 1002 according to some aspects. The debris separator device 1002 can be disposed in tubular member 1004, e.g., in a portion of the casing string 1012 in FIG. 1. The debris separator device 1002 can include multiple weirs 1014. The weirs 1014 can be positioned in multiple insert sections 1006, 1007, 1008, 1009, 1010, 1011, 1012 (e.g., insert sections 1009, 1010 are shown as transparent so that weirs 1014 are visible). The insert sections 1006-1012 may be coupled in series by any suitable coupler.

The weirs 1014 can be oriented within the insert sections 1006-1012, and the debris separator device 1002 as a whole, so as to selectively increase fluid velocity through the debris separator device 1002. This may cause a solids slip velocity that separates solids from fluid within a desired section of the wellbore. In one example, the weirs 1014 are oriented such that a flow opening of a first weir 1014A causes solids to deposit at a second weir 1014A (if flow direction is from the first weir 1014A to the second weir 1014A) without obstructing a flow opening of the second weir 1014B.

Figure 11:
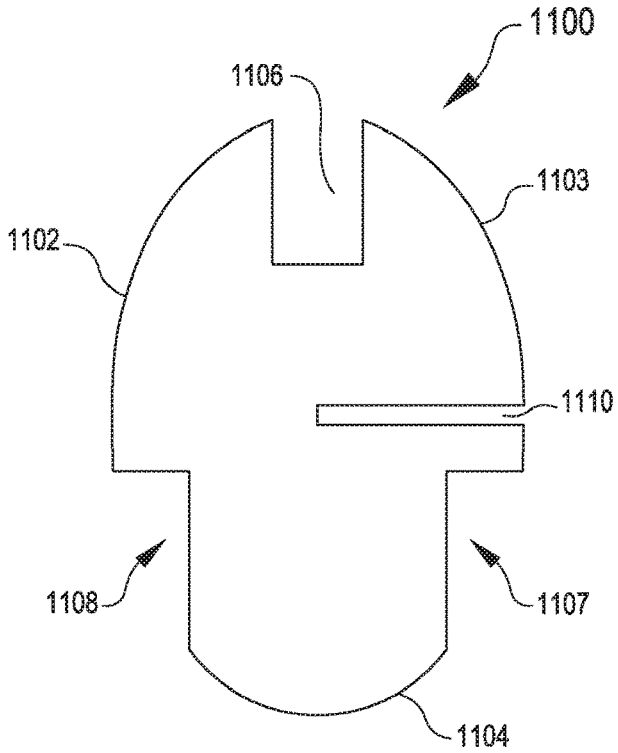
FIG. 11 is a front view of an example of a weir plate for the debris separator device of FIG. 10 according to certain aspects.

The weirs 1014 may be constructed from weir plates. FIG. 11 depicts a front view of an example of a weir plate 1100, in accordance with some aspects. The weir plate 1100 may comprise plastic, metal, a combination thereof, or the like. In at least one aspect, the weir plate 1100 comprises a semi-permeable material, such as a mesh material. The weir plate 1100 can be dimensioned so as to fit within a weir assembly (such as debris separator device 1002 of FIG. 10). The weir plate 1100 can include edges 1102, 1103, 1104 dimensioned to come in contact with one or more interior surfaces of the debris separator device 1002. For example, the edges 1102, 1103, 1104 shown in FIG. 11 are curved so as to fit within and abut a curved interior surface of the debris separator device 1002 such that fluid cannot easily pass between the interior surface of the debris separator device 1002 and the edges 1102, 1103, 1104 of the weir plate 1100.

The weir plate 1100 can include one or more flow openings 1106, 1107, 1108. Fluid can flow through the flow openings 1106, 1107, 1108 of the weir plate 1100 within debris separator device 1002. Although the weir plate 1100 shown in FIG. 11 has three flow openings 1106, 1107, 1108, more or fewer flow openings can be included. The shape, location and orientation of the flow openings 1106, 1107, 1108 may differ for different weir plates so as to create a desired tortuous fluid flow path within debris separator device 1002. The weir plate 1100 can include a slot 1110 for receipt of a second weir plate to form a weir as described in greater detail with reference to FIG. 12.

Figure 12:
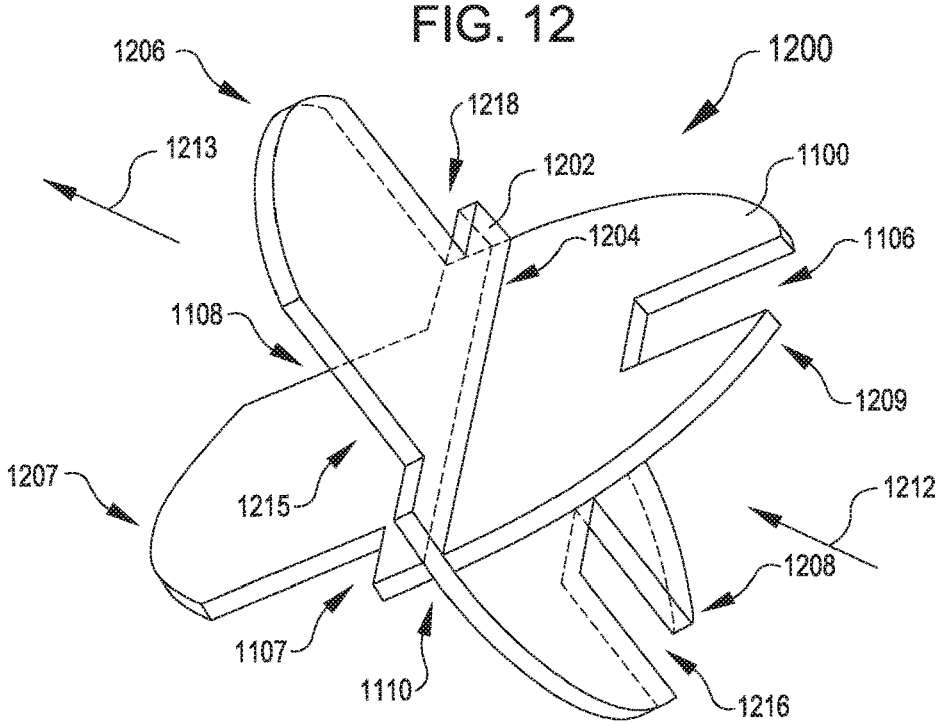
FIG. 12 is a perspective view of an example of a weir for the debris separator device of FIG. 10 according to certain aspects.

FIG. 12 depicts an example weir 1200, in accordance with some aspects. The weir 1200 shown in FIG. 12 includes the first weir plate 1100 of FIG. 11, coupled to a second weir plate 1202 via the slot 1110 of the first weir plate 1100 and a slot 1204 of the second weir plate 1202. However, the weir 1200 additionally or alternatively may include more or fewer weir plates 1100, 1202 or use other couplers. The weir 1200 can include a plurality of wings 1206, 1207, 1208, 1209. In various aspects, a major portion of a first wing 1206 of the plurality of wings 1206, 1207, 1208, 1209 is nonparallel to a major portion of a second wing 1207 of the plurality of wings 1206, 1207, 1208, 1209. In some aspects, the weir 1200 can include a single unit having a plurality of wings 1206, 1207, 1208, 1209 rather than coupled weir plates 1100, 1202. In some aspects, the components of the weir 1200 are arranged such that flow openings of a first wing 1100, 1208 of the weir 1200 cause solids to deposit on a second wing 1206, 1207 of the same weir 1200, e.g., causing the second wing 1206 to function as a debris-capturing pocket.

The wings 1206, 1207, 1208, 1209 of the weir 1200 can be oriented so as to create a tortuous fluid flow path and increase the separation of solids from fluid within the debris separator device 1002. As an illustrative example, fluid flowing in the direction indicated by arrows 1212, 1213 can be forced through flow openings 1106, 1216. The fluid can continue through the flow openings 1107, 1108, 1217, 1218. During this movement, solids may be deposited at the portion of the first weir plate 1100 between flow opening 1107 and flow opening 1108. Solids may also be deposited at the portion of the second weir plate 1202 between flow opening 1217 and flow opening 1218. In sum, the flow opening 1106 of wing 1209 can cause solids to deposit at wing 1206 without obstructing one or more of the flow openings 1217, 1218 of the wing 1206. and the flow opening 1216 of wing 1208 can cause solids to deposit at wing 1207 without obstructing one or more of the flow openings 1107, 1108 of the wing 1207. While the weir 1200 shown in FIG. 12 includes two weir plates 1100, 1202 of the same design, in some aspects, the weir 1200 may comprise weir plates of different designs. For example, the second weir plate 1202 may comprise more or less flow openings 1216, 1217, 1218 than the first weir plate 1100, and the flow openings 1216, 1217, 1218 may be of any size and shape suitable to create a desired tortuous fluid flow path.

Figure 13:
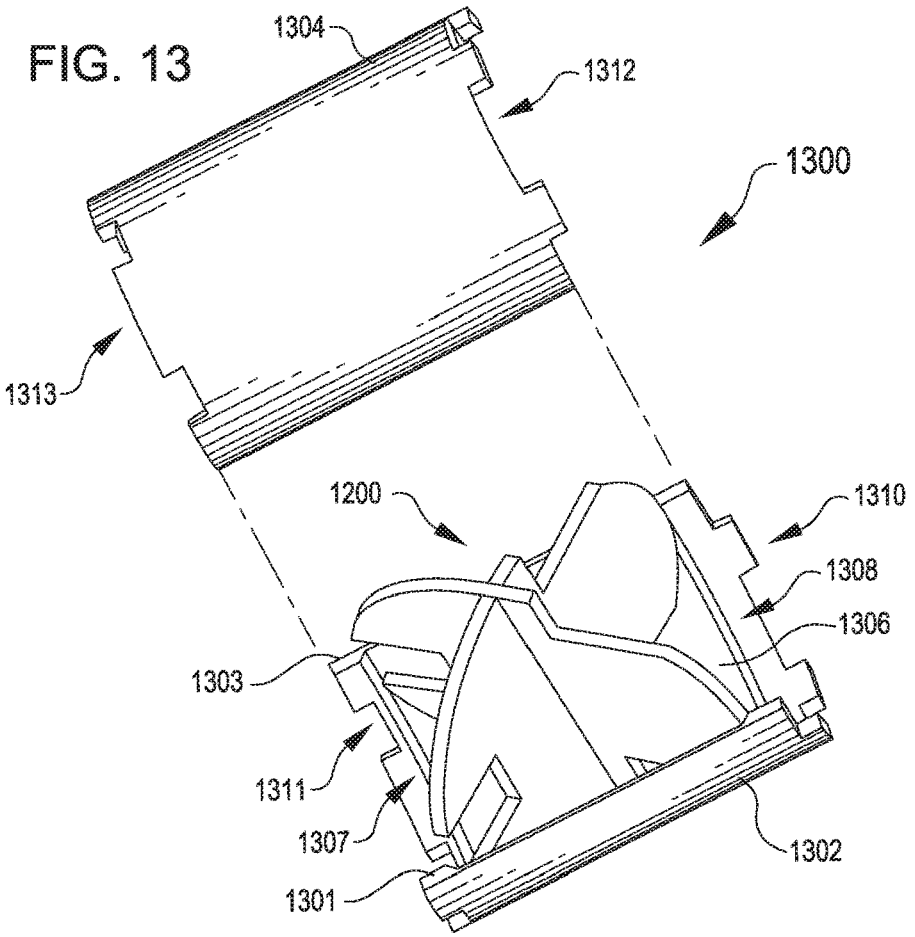
FIG. 13 is an exploded assembly view of an example of a weir assembly for the debris separator device of FIG. 10 according to certain aspects.

FIG. 13 depicts an example weir assembly 1300, according to various aspects. The weir assembly 1300 generally can include a weir, for example, the weir 1200 of FIG. 12, a first portion of an insert 1302, and a second portion of an insert 1304. The weir 1200 can be inserted into a slot 1306 of the first portion of the insert 1302. While the slot 1306 is shown in FIG. 13 as ridges 1307, 1308, any of a variety features may be used to form the slot 1306 or maintain the location and orientation of the weir 1200 in the first portion of the insert 1302. The second portion of the insert 1304 can also include a slot to maintain the location and orientation of the weir 1200 within the second portion of the insert 1304.

The second portion of the insert 1304 can be coupled to the first portion of the insert 1302 by bonding at 1301 and 1303. Non-limiting examples of bonding include adhesives, welds, solder, and other surface joining techniques or materials. Any other suitable coupler additionally or alternatively may be used, including, but not limited to other couplers discussed herein, combinations thereof, or the like. The bonding may fix the orientation of the bonded pieces relative to one another. Each of the first and second portions of the insert, 1302, 1304 shown in FIG. 13 include coupling edges 1310, 1311, 1312, 1313. These features can function as couplers to facilitate coupling of the weir assembly 1300 to another weir assembly or other apparatus. However, other couplers may also be used to couple the weir assembly 1300 with other components within the debris separator device 1002. Weir assemblies may be coupled together in an arrangement that causes weirs to be oriented differently from one another (e.g., as the weirs 1014A and 1014B are aligned differently to one another in FIG. 10). Such an arrangement may increase an amount of debris separation provided by the debris separator device 1002

Example #4 Debris Separator Device with Impellers

Figure 14:
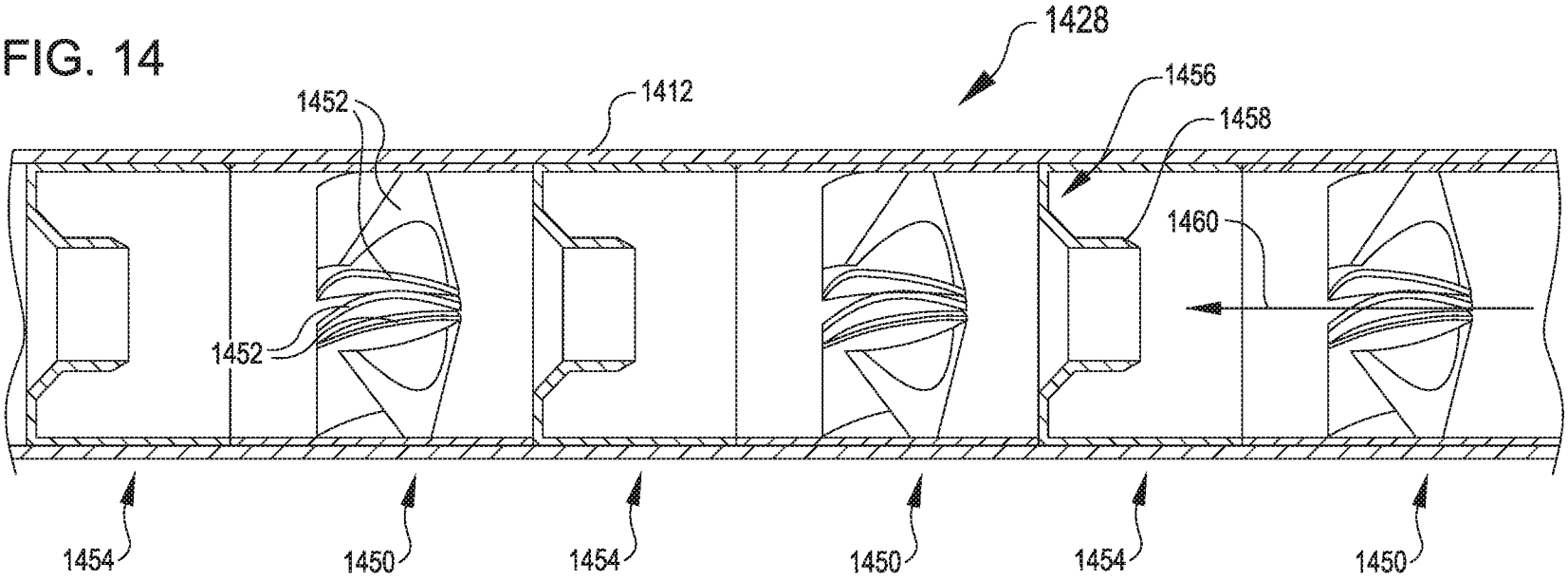
FIG. 14 is a side cutaway view of yet another example of a debris separator device according to certain aspects.
Figure 15:
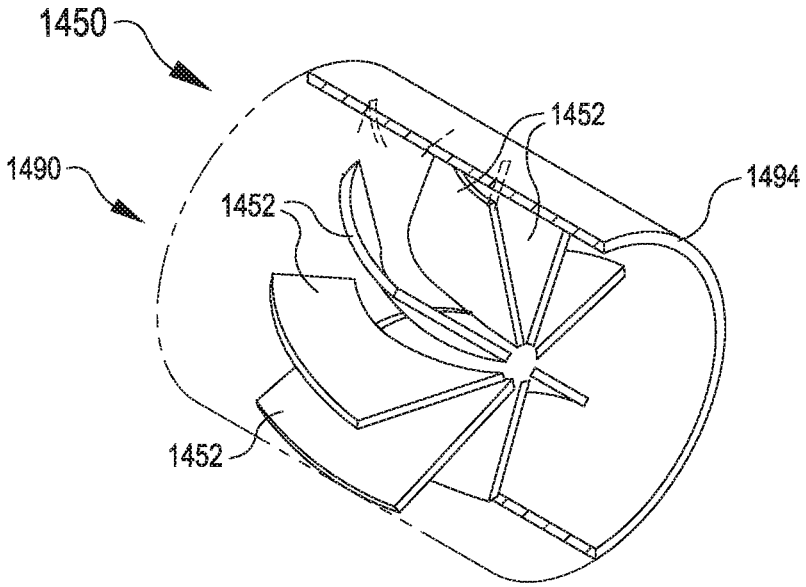
FIG. 15 is a perspective cutaway view of an example of an impeller insert for the debris separator device of FIG. 14 according to certain aspects.
Figure 16:
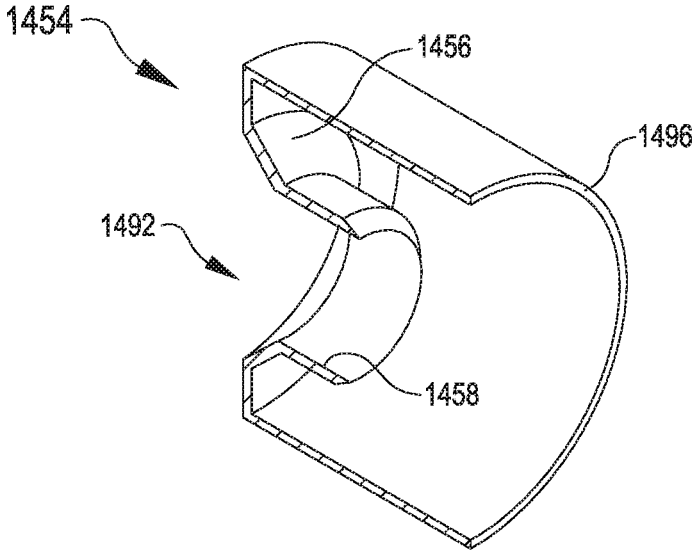
FIG. 16 is a perspective cutaway view of an example of a baffle insert for the debris separator device of FIG. 14 according to certain aspects.

FIGS. 14-16 illustrate yet another example of a debris separator device 1428. The debris separator device 1428 can include impellers 1450, which may generate a vortex to separate debris, such as through centrifugal force on the debris. The debris may be directed by the impellers 1450 into annular pockets formed by baffles 1454. The debris separator device 1428 can be modular by including contact surfaces (or other features) that allow the impellers 1450 or baffles 1454 (or inserts 1490, 1492 in which they are housed) to be readily added, subtracted, or substituted to change the operation debris separator device 1428.

FIG. 14 is a perspective cutaway view of the debris separator device 1428. The debris separator device 1428 may include an impeller 1450 having a plurality of blades 1452 that can generate a vortex of mud in the debris separator device 1428, e.g., as the debris separator device 1428 is lowered into the wellbore. As illustrated, the debris separator device 1428 may include several such impellers 1450 disposed at intervals along the length of the debris separator device 1428. As debris laden mud enters the debris separator device 1428, the mud may begin to rotate and form a vortex as it passes over the impeller blades 1452. In some embodiments, the impellers 1450 are stationary with respect to debris separator device 1428, so that the fluid rotates as a result of the force of the fluid passing over the blades 1452. As the fluid vortex rotates, the cuttings, debris, and other heavier particles in the mud may be thrown to the outer circumferential section of the vortex due to the centrifugal inertia of these heavier particles. Thus, the impeller 1450 may function to centrifuge the mud.

The debris separator device 1428 may also include a baffle 1454. The baffle 1454 can catch the heavy particles that are thrown to the outside of the mud vortex via the impeller 1450. Specifically, the baffle 1454 may feature an annular cup shape that forms an outer circumferential pocket 1456 within the debris separator device 1428 to capture cuttings from the vortex of mud generated by the impeller 1450. In some embodiments, the baffle 1454 may also include a reduced diameter nozzle 1458 that forms a wall of the annular pocket 1456 and directs surface-pumped fluid through the center of the debris separator device 1428 to draw the cuttings out of the outer circumferential pocket 1456 when desired. The reduced diameter nozzle 1458 may enable clean mud to pass through the center of the baffle 1454 toward the float collar and main casing string described above.

The debris separator device 1428 shown in FIG. 14 can include several such baffles 1454 disposed periodically along the length of the debris separator device 1428. In some embodiments, the baffles 1454 and impellers 1450 may be positioned along the length of the debris separator device 1428 in an alternating fashion, although other arrangements may be used in other embodiments. As illustrated, one or more of the baffles 1454 may be disposed adjacent a corresponding impeller 1450 such that, as debris separator device 1428 is lowered into the wellbore, the mud enters the debris separator device 1428 (in a direction indicated by arrow 1460) and moves across the impeller 1450 toward the baffle 1454. This may allow the impeller 1450 to force the mud into a vortex prior to the mud reaching the baffle 1454.

FIGS. 15 and 16 illustrate embodiments of an impeller insert 1490 and a baffle insert 1492, respectively. As shown in FIG. 15, the impeller insert 1490 may include an outer circumferential wall 1494 that surrounds the plurality of impeller blades 1452. As discussed above, the impeller 1450 may include stationary blades 1452 that do not rotate with respect to the casing system. The blades 1452 of FIG. 15 may be coupled and held stationary with respect to the outer circumferential wall 1494 of the impeller insert 1490. The impeller insert 1490 may be disposed in a length of tubular member (such as the casing string 112 of FIG. 1) and attached to an inner surface of the tubular member to secure the impeller 1450 within the tubular member.

As illustrated in FIG. 16, the baffle insert 1492 may also include an outer circumferential wall 1496 that surrounds the outer circumferential pocket 1456 and the reduced diameter nozzle 1458 of the baffle 1454. The baffle insert 1492 may be disposed in a length of tubular member (such as the casing string 112 of FIG. 1) and attached to an inner surface of the tubular member to secure the baffle 1454 within the tubular member at a desired position relative to the impeller insert 1490. The impeller insert 1490 and the baffle insert 1492 may include outer circumferential walls 1494 and 1496 that are approximately the same inner and outer diameters, e.g., in order to create a smooth internal flow path for mud that enters the casing system as the system is lowered into the wellbore. These inserts 1490 and 1492 may feature contact surfaces that allow the inserts 1490 and 1492 to be relatively easy to stack against each other, allowing a user to install as many or as few inserts as desired by simply placing the inserts 1490 and 1492 inside a portion of casing. For example, the user may install these inserts into the shoe track behind the casing shoe of the casing system. Accordingly, the inserts 1490 and 1492 may facilitate a plurality of impellers 1450 and baffles 1454 that are attachable to one another (e.g., by stacking or other couplers) to form a string of impellers 1450 and baffles 1454 of any length and having any ratio of impellers 1450 to baffles 1454. Any desirable number of impeller inserts 1490 and baffle inserts 1492 may be utilized to form this string of components. In other embodiments, the impeller 1450 and the baffle 1454 may be components that are attachable to one another to form the debris separator device 1428 without being installed as inserts. For example, the components may be connected by a mandrel or other structure along a periphery or other location of the components.

Processes for Implementing Modular Debris Separators

Figure 17:
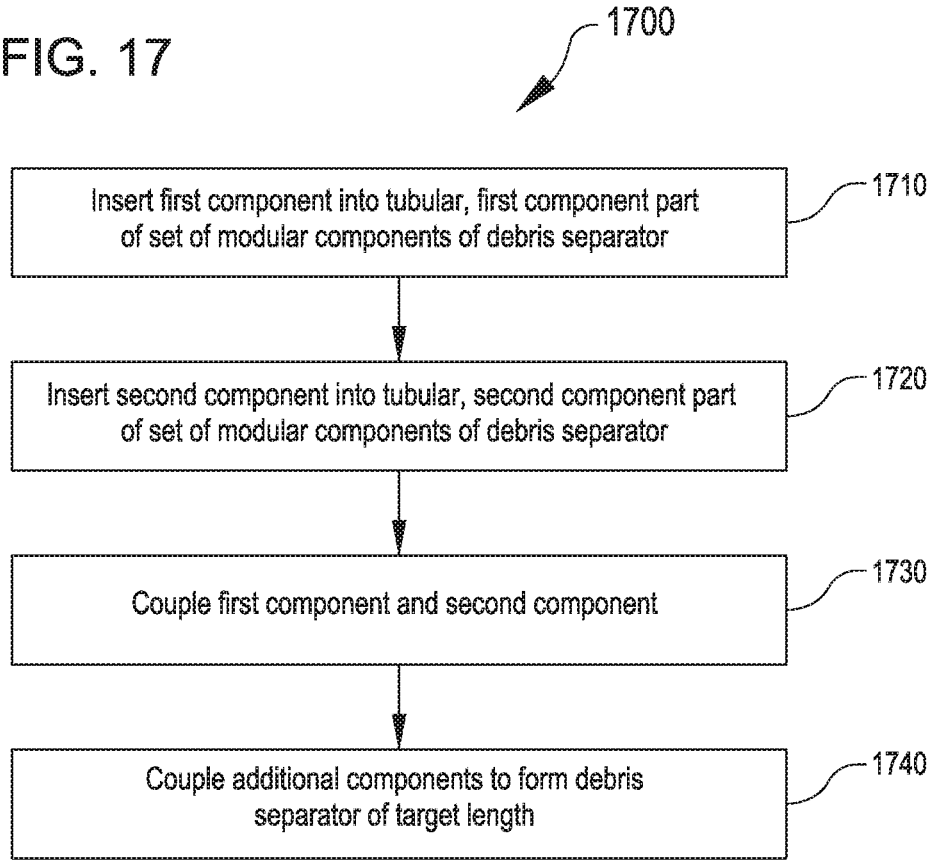
FIG. 17 is a flow chart illustrating a process for implementing a modular debris separator device according to certain aspects.

FIG. 17 is a flow chart illustrating a process 1700 of implementing a modular debris separator device. The process 1700 may utilize any combination of components and couplers, including any of those discussed above. In some aspects, the process has particular application for the debris separator devices discussed above or other debris separator devices that are flushable (e.g., that include components arranged such that fluid flow can be directed in a second direction to flush debris from surfaces that had captured debris from fluid flow in a first direction).

At block 1720, the process 1700 can include inserting a first component into a tubular, e.g., casing string 112 in FIG. 1. The first component can be part of or included in a set of modular components that can be coupled together in different combinations to form respectively different configurations of a modular debris separator assembly. As non-limiting examples, the first component can be any of the above-described plates, mandrels, end caps, screens, weirs, weir plates, insert sections, impellers, baffles, sections, or inserts.

At block 1720, the process 1700 can include inserting a second component into the tubular. Like the first component, the second component can also be part of or included in the set of modular components that can be coupled together in different combinations to form respectively different configurations of a modular downhole debris separator assembly. In some aspects, the first component and the second component may be components from different of the previously discussed numbered Examples #1-4.

At block 1730, the process 1700 can include coupling the first component with the second component. Coupling the first and second components can form at least a part of the downhole modular debris separator assembly, e.g., the downhole modular debris separator that can be formed by the set of components. Any suitable coupler or coupling technique can be used to perform this coupling operation. As non-limiting examples, the first component and the second component may be coupled by snap-fitting interfaces (e.g., the illustrated prongs of Example 1 or other structures that are sized to deflect when being received by a mating structure and to return toward an un-deflected state when moved to a fully received or engaged state with that mating structure), cooperating threads (e.g., the illustrated threads of Example 2), securing pins (e.g., the illustrated key of Example 1 or other pins that traverse openings of multiple components), bonding (e.g., the illustrated insert sections of Example 3), slip-fitting interfaces (e.g., the illustrated slots of the weirs of example 3 or other structures sized relative to one another so as to be moveable relative to one another by hand), or stacking interfaces (e.g., the illustrated impeller inserts and baffle inserts of Example 4). Such couplers may be utilized with any components, not solely the components in the foregoing examples. Additionally, although the figures corresponding to the foregoing examples illustrate specific combinations of debris separating techniques and coupling techniques, other combinations are possible.

The order of operations of blocks 1720, 1720, and 1730 may be varied according to different aspects. In some aspects, coupling may occur after the first component is inserted into the tubular. As an illustrative example, a first component (e.g., a baffle insert) may be installed in the tubular, and the second component (e.g., an impeller insert) may be coupled with the first while the first is located in the tubular. This may allow operators to assemble and install a debris separator device in a single operation, such as may provide time savings in some scenarios. In some aspects, coupling may occur before the second component is inserted into the tubular. As an illustrative example, a first component (e.g., an end cap) and a second component (e.g., a mandrel) may be coupled together before installing a completed assembly into a tubular. This may allow components to be reached more easily to engage couplers, such as may facilitate ease of assembly in some scenarios.

In some aspects, e.g., at block 1740, the first and second components (e.g., weir assemblies) can be coupled with an additional number of components of the set (e.g., an additional number of weirs assemblies). The additional number of components may be selected so as to form a downhole modular debris separator assembly of a target length (e.g., such as one half or other fraction of a length of joint of a casing string 112). For example, this may allow a debris separator to be assembled on site with a length determined by space constraints, debris levels, or other parameters of a particular well. In general, the modular construction of debris separator devices such as shown and described herein can allow the components of the debris separator device to be collectively assembled and inserted into a tubular member. Alternatively, the components can be added to components of an assembly already positioned within a tubular member. Additionally, the components of the debris separator device can be transported to a worksite in an already-assembled fashion or an unassembled fashioned for construction at the site.

In some aspects, a downhole assembly, a system, or a method is provided according to one or more of the following examples or according to some combination of the elements thereof. In some aspects, a tool or a system described in one or more of these examples can be utilized to perform a method described in one of the other examples.

Example #1

Provided can be a debris separator comprising a plurality of modular components that are each modular by including at least one coupler formed so as to be connectable with a coupler of another component of the plurality of modular components, the plurality of modular components connectable together by the couplers into an assembly that is positionable downhole in a well to separate debris from wellbore fluid passed through the assembly.

Example #2

Provided can be the debris separator of Example #1, wherein the assembly comprises at least one of: (i) plates with pass-through areas angularly offset from one another within the assembly; (ii) screens covering different portions of a bore of a tubular and longitudinally offset from one another; (iii) weirs; or (iv) impellers and baffles.

Example #3

Provided can be the debris separator of Example #1 (or any of Examples #1-2), wherein at least one pair of the plurality of modular components are connectable together by couplers that comprise snap-fitting interfaces that include at least a first structure and a second structure, the first structure sized to deflect when being received by the second structure and to return toward an un-deflected state when fully received by the second structure.

Example #4

Provided can be the debris separator of Example #1 (or any of Examples #1-3), wherein at least one pair of the plurality of modular components are connectable together by couplers that comprise a female threaded surface receiving a male threaded surface.

Example #5

Provided can be the debris separator of Example #1 (or any of Examples #1-4), wherein at least one pair of the plurality of modular components are connectable together by couplers that comprise securing pins traversing openings in each component coupled by the securing pins.

Example #6

Provided can be the debris separator of Example #1 (or any of Examples #1-6), wherein at least one pair of the plurality of modular components are connectable together by couplers that comprise slip-fitting interfaces including surfaces that are sized relative to one another so as to be moveable relative to one another by hand.

Example #7

Provided can be the debris separator of Example #1 (or any of Examples #1-6), further comprising a tubular containing the assembly, wherein at least some of the plurality of the modular components are connectable with the tubular.

Example #8

Provided can be a method (which may incorporate features of any of Examples #1-7) comprising: (i) inserting a first component into a tubular, the first component included in a set of components that fit together in different combinations to form respectively different configurations of a modular debris separator assembly that is positionable downhole in a well to separate debris from wellbore fluid passed through the assembly; (ii) inserting a second component of the set into the tubular; and (iii) coupling the first component with the second component so as to form at least a part of the modular debris separator assembly.

Example #9

Provided can be the method of Example #8, wherein the coupling the first component with the second component occurs after inserting the first component into the tubular.

Example #10

Provided can be the method of Example #8 (or any of Examples #8-9), wherein the coupling the first component with the second component occurs before inserting the second component into the tubular.

Example #11

Provided can be the method of Example #8 (or any of Examples #8-10), wherein the different combinations differ in at least one of quantity of components, order of components, or relative orientation of components.

Example #12

Provided can be the method of Example #8 (or any of Examples #8-11), further comprising coupling the first component and the second component with an additional number of components of the set, the additional number of components selected so as to form a downhole modular debris separator assembly of a target length.

Example #13

Provided can be the method of Example #8 (or any of Examples #8-12), wherein coupling the first component with the second component comprises connecting the first component to the second component by one or more couplers arranged on or among the first component and the second component.

Example #14

Provided can be the method of Example #8 (or any of Examples #8-13), wherein coupling the first component with the second component comprises coupling the first component with the second component by an intervening structure.

Example #15

Provided can be the method of Example #8 (or any of Examples #8-14), wherein coupling the first component with the second component comprises bonding the first component and the second component to one another or to an intervening structure so as to fix a relative orientation between the first component and the second component.

Example #16

Provided can be a system (which may incorporate features of any of Examples #1-15) comprising: (i) a first sub-assembly of a modular debris separator assembly that is positionable downhole in a well to separate debris from wellbore fluid passed through the assembly; and (ii) a number of additional sub-assemblies of the debris separator assembly coupled in series with the first sub-assembly, the number of additional sub-assemblies selected so as to extend the downhole modular debris separator assembly to a target length.

Example #17

Provided can be the system of Example #16, wherein the target length is less than a length of a single joint of a tubular in which the debris separator assembly is positioned when the debris separator assembly is positioned downhole.

Example #18

Provided can be the system of Example #16 (or any of Examples #16-17), wherein the first sub-assembly is coupled with the number of additional sub-assemblies by couplers comprising at least one of (i) snap-fitting interfaces; (ii) cooperating threads; (iii) securing pins; (iv) bonding; (v) slip-fitting interfaces; or (vi) stacking interfaces.

Example #19

Provided can be the system of Example #18 (or any of Examples #16-18), wherein each of the sub-assemblies comprises at least one of: (i) plates with pass-through areas angularly offset from one another within the assembly; (ii) screens covering different portions of a bore of a tubular and longitudinally offset from one another; (iii) weirs; or (iv) impellers and baffles.

Example #20

Provided can be the system of Example #16 (or any of Examples #16-19), further comprising: (i) a float collar; (ii) a float shoe; and (iii) a joint of a casing string positioned between the float collar and the float shoe and containing the modular debris separator assembly.

The foregoing description, including illustrated aspects and examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure.

What is claimed is:

1. A debris separator comprising:

a plurality of modular components, wherein the plurality of modular components are each modular by including at least one coupler formed so as to be connectable with a coupler of another component of the plurality of modular components, the plurality of modular components connectable together by the couplers into an assembly that is positioned within a tubular, wherein the tubular is positionable downhole in a well in a shoe track of a casing string to separate debris from wellbore fluid passed through an inner region of the tubular.

2. The debris separator of claim 1, wherein the assembly comprises at least one of:

plates with pass-through areas angularly offset from one another within the assembly;

screens covering different portions of a bore of a tubular and longitudinally offset from one another;

weirs; or impellers and baffles.

3. The debris separator of claim 1, wherein at least one pair of the plurality of modular components are connectable together by couplers that comprise snap-fitting interfaces that include at least a first structure and a second structure, the first structure sized to deflect when being received by the second structure and to return toward an un-deflected state when fully received by the second structure.

4. The debris separator of claim 1, wherein at least one pair of the plurality of modular components are connectable together by couplers that comprise a female threaded surface receiving a male threaded surface.

5. The debris separator of claim 1, wherein at least one pair of the plurality of modular components are connectable together by couplers that comprise securing pins traversing openings in each component coupled by the securing pins.

6. The debris separator of claim 1, wherein at least one pair of the plurality of modular components are connectable together by couplers that comprise slip-fitting interfaces including surfaces that are sized relative to one another so as to be moveable relative to one another by hand.

7. The debris separator of claim 1, wherein at least some of the plurality of the modular components are connectable with the tubular.

8. A method comprising:

inserting a first component into a tubular, the first component included in a set of components that fit together in different combinations to form respectively different configurations of a modular debris separator assembly that is positionable downhole in a well to separate debris from wellbore fluid passed through an inner region of the tubular;

inserting a second component of the set into the tubular; and coupling the first component with the second component so as to form at least a part of the modular debris separator assembly.

9. The method of claim 8, wherein the coupling the first component with the second component occurs after inserting the first component into the tubular.

10. The method of claim 8, wherein the coupling the first component with the second component occurs before inserting the second component into the tubular.

11. The method of claim 8, wherein the different combinations differ in at least one of quantity of components, order of components, or relative orientation of components.

12. The method of claim 8, further comprising coupling the first component and the second component with an additional number of components of the set, the additional number of components selected so as to form a downhole modular debris separator assembly of a target length.

13. The method of claim 8, wherein coupling the first component with the second component comprises connecting the first component to the second component by one or more couplers arranged on or among the first component and the second component.

14. The method of claim 8, wherein coupling the first component with the second component comprises coupling the first component with the second component by an intervening structure.

15. The method of claim 8, wherein coupling the first component with the second component comprises bonding the first component and the second component to one another or to an intervening structure so as to fix a relative orientation between the first component and the second component.

16. The method of claim 8, further comprising positioning the tubular including the modular debris separator assembly between a float collar and a float shoe.

17. A system comprising:

a first sub-assembly of a debris separator assembly that is positionable downhole in a well to separate debris from wellbore fluid passed through the assembly;

a number of additional sub-assemblies of the debris separator assembly coupled in series with the first sub-assembly, the number of additional sub-assemblies selected so as to extend the debris separator assembly to a target length;

a float collar;

a float shoe; and a joint of a casing string positioned between the float collar and the float shoe and containing the debris separator assembly.

18. The system of claim 17, wherein the target length is less than a length of a single joint of a tubular in which the debris separator assembly is positioned when the debris separator assembly is positioned downhole.

19. The system of claim 17, wherein the first sub-assembly is coupled with the number of additional sub-assemblies by couplers comprising at least one of (i) snap-fitting interfaces; (ii) cooperating threads; (iii) securing pins; (iv) bonding; (v) slip-fitting interfaces; or (vi) stacking interfaces.

20. The system of claim 19, wherein each of the sub-assemblies comprises at least one of: (i) plates with pass-through areas angularly offset from one another within the assembly; (ii) screens covering different portions of a bore of a tubular and longitudinally offset from one another; (iii) weirs; or (iv) impellers and baffles.

* * * * *